US005877670A

United States Patent [19]

Sehlhorst et al.

[11] Patent Number: 5,877,670

[45] Date of Patent: Mar. 2, 1999

[54] HEAT MOTOR OPERATED LOAD REGULATING SWITCH ASSEMBLY AND KNOB ATTACHMENT THEREFOR

[76] Inventors: Scott B. Sehlhorst, 5615 Old Dover Rd. #7, Fort Wayne, Ind. 46835; Stephen Schamberger, 3220 E. Mapes Rd., Kendallville, Ind. 46755

[21] Appl. No.: 851,191

[22] Filed: May 5, 1997

Related U.S. Application Data

[63] Continuation-in-part of Ser. No. 797,531, Feb. 7, 1997, abandoned.

[51] Int. Cl.[6] ..... H01H 37/02; H01H 37/14; H01H 37/32; H01H 37/52

[52] U.S. Cl. ..... 337/302; 337/369; 337/327; 337/305; 337/309; 337/311; 337/312; 337/324

[58] Field of Search ..... 337/103, 105, 337/57, 82, 107, 93, 94, 51–53, 41, 37–39, 101, 104, 113, 36, 42, 337, 333, 342, 394, 380, 348, 324, 377, 106, 369

[56] References Cited

U.S. PATENT DOCUMENTS

| | | | |
|---|---|---|---|
| 5,021,762 | 6/1991 | Hetrick | 337/103 |
| 5,191,310 | 3/1993 | Obermann et al. | 337/105 |
| 5,696,479 | 12/1997 | Oughton et al. | 337/333 |

*Primary Examiner*—Leo P. Picard
*Assistant Examiner*—Anatoly Vortman
*Attorney, Agent, or Firm*—Terrence Martin; Jules Jay Morris; Sean D. Detweiler

[57] ABSTRACT

A user adjustable switching controller for duty cycle regulating flow of current to an electrical load such as a resistance heater, particularly for cooking appliances. A load current switch, when closed by a user operated cam also energizes a heat motor which includes a resistive strip attached to one active leg of a U-shaped bi-metal member. In one embodiment the integrally formed load current switch snap spring is securely attached to the heated leg of a U-shaped bi-metal and the moveable contact arm pivoted on the base. The other leg of the U-shaped bi-metal is anchored to a base including one of the load-connecting stationary terminals; and, the anchored leg serves to provide ambient temperature compensation. In another embodiment, the integrally formed blade spring of the moveable contact member is pivoted on the active leg of the U-shaped bi-metal and the moveable contact arm welded to the base. User rotation of the cam deflects a bias spring which acts on the portion of the bi-metal attached to the load switch snap spring to effect closing of the load current switch and energization of the heat motor. Heating of the bi-metal causes warpage which overcomes the bias spring to open the load switch and shut off the heat motor. Cooling of the bi-metal allows the load current switch to re-close repeating the cycle. User adjustment of the cam varies the bias on the snap spring and thus the re-open point of the switch with respect to the cycle, thereby varying the ratio of "on" to "off" time of the load current. The heat motor sub-assembly including the base with the load connecting terminal, the U-shaped bi-metal, the heater and the moveable contact arm and heater connecting chip is pre-fabricated and installed in the controller housing as a unit.

12 Claims, 17 Drawing Sheets

PRIOR ART
FIG. 9
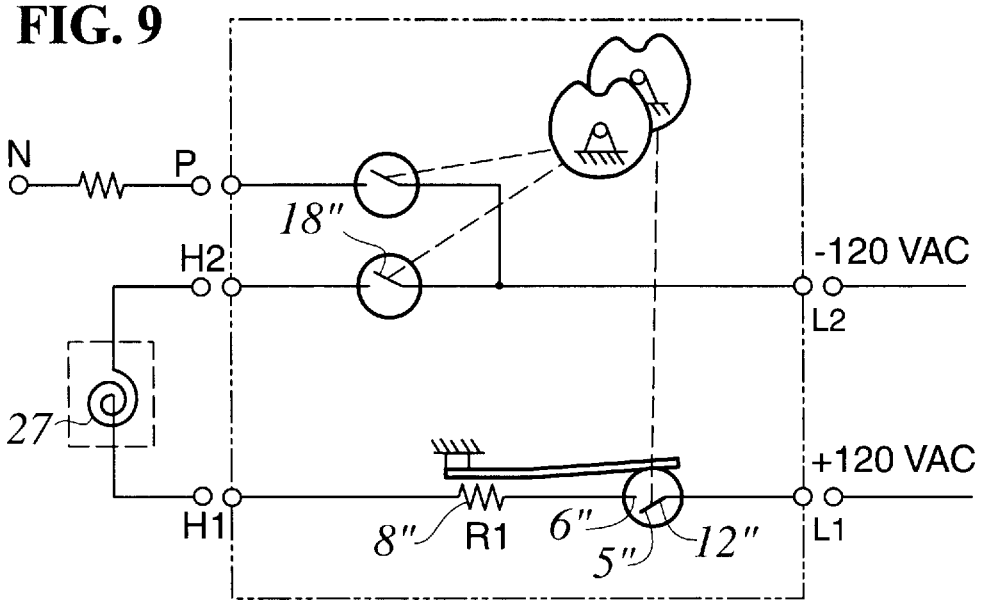
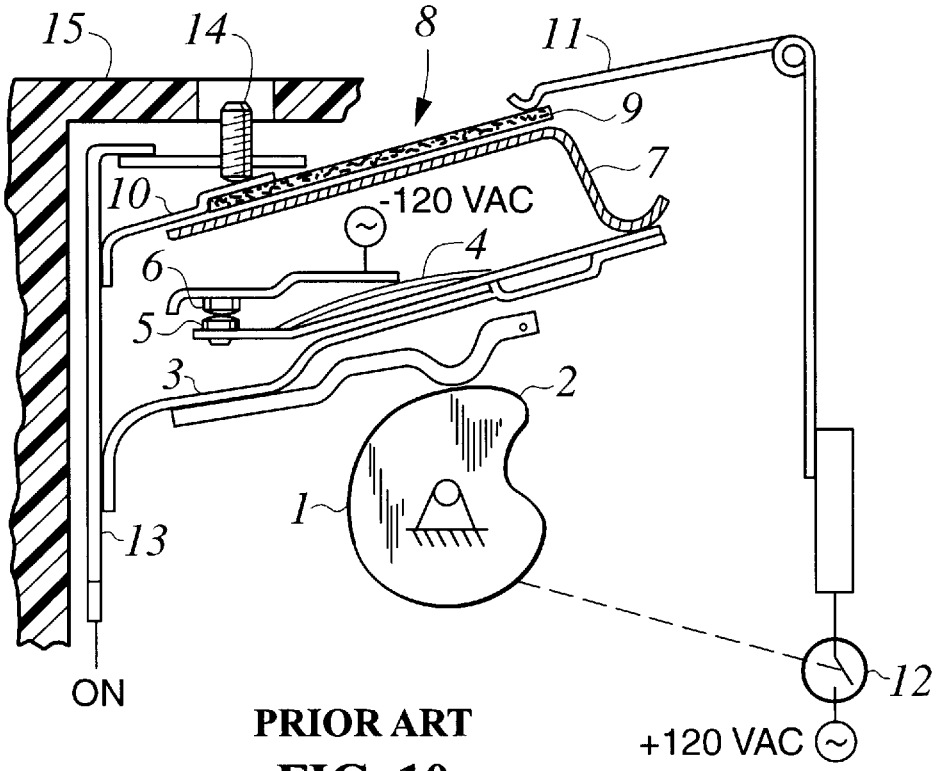
PRIOR ART
FIG. 10

FIG. 17
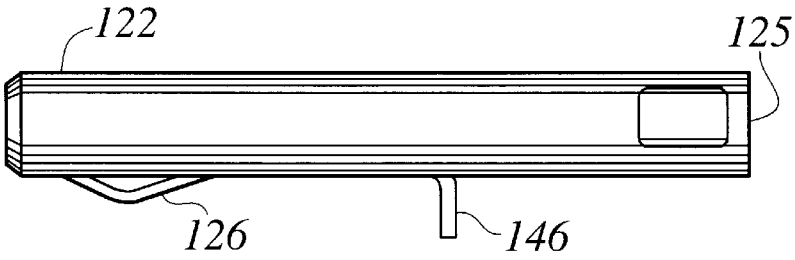
FIG. 18
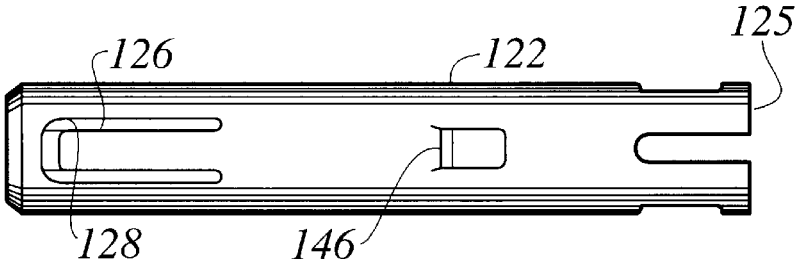
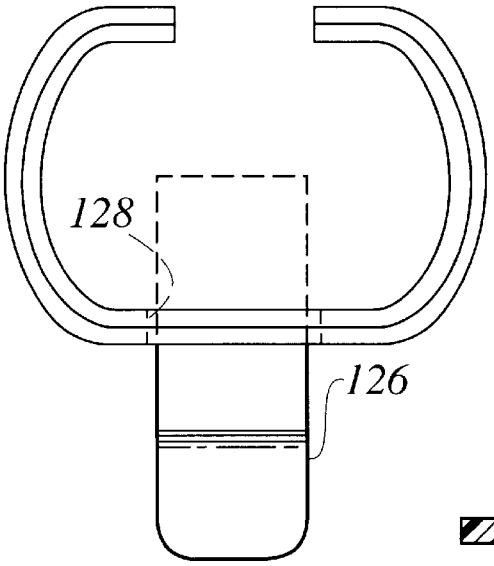
FIG. 19
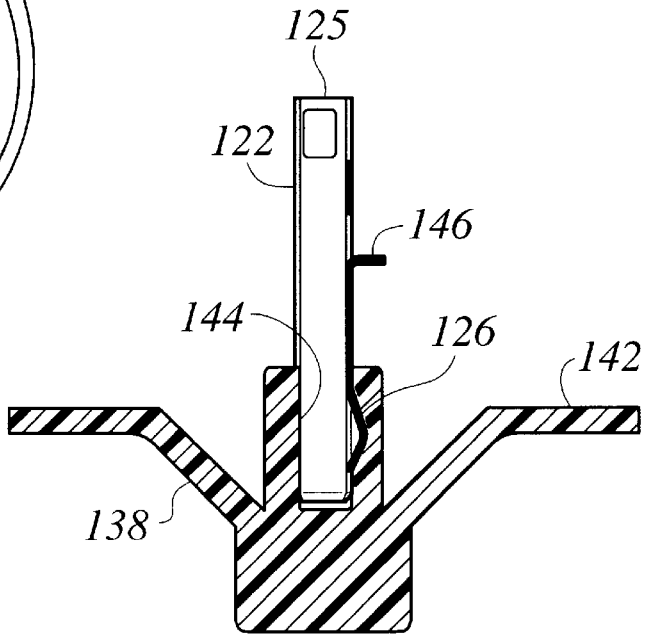
FIG. 23

HEAT MOTOR OPERATED LOAD REGULATING SWITCH ASSEMBLY AND KNOB ATTACHMENT THEREFOR

CROSS-REFERENCE TO RELATED APPLICATIONS

This Application is a Continuation-In-Part of commonly owned application entitled "Heat Motor Operated Load Regulating Switch Assembly and Knob Attachment Therefor, Ser. No. 08/797,531, Filed Feb 7, 1998 ", now abandoned.

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to controllers or switch assemblies used for fractional duty cycle modulation of an electrical load, for example an electrical resistance heater employed in an oven or range top "burner" heater. Controllers of this type are employed in domestic cooking appliances; and, typically the duty cycle of the heater is variable by user rotation of a control knob associated with the switch assembly controlling the load current to the heater.

Heretofore, controllers for domestic cooking ovens of the aforesaid type, have utilized a cam which moves with the user rotatable knob for varying the bias on the load current switch which is actuated by a heat motor energized only when load current is flowing through the heater switch. The user rotation of the control knob positions the cam to provide a predetermined bias on the load current switch actuating mechanism which in turn varies the amount of time that the load heater is on. The heat motor includes a resistance which is typically connected for heating a bi-metal actuator which warps in response to heat transfer from the resistance to cause de-actuation of the switch which cuts off of the load current to the oven heater and to the heat motor. In such an arrangement, the time required for the bi-metal actuator to cool upon opening of the load current switch determines the ratio of the "on" time to "off" time.

Known constructions for variable duty cycle load or heater controllers have employed a bi-metal actuator for the load current switch which has a heat motor attached thereto comprising a relatively thin film resistive heater superposed on a rigid substrate and mounted on the bi-metal member. This arrangement of the heat motor has been found generally operative; however, as the bi-metal member is heated by heat transfer from the heat motor, the warpage or deflection induced in the bi-metal member causes the bi-metal to pull away from the rigid heat motor substrate, thereby diminishing the heat transfer from the heat motor to the bi-metal and introducing inaccuracies non-proportionality and hysteresis in the movement of the bi-metal with respect to the energy input to the heater. This warpage of the bi-metal away from the heater has resulted in difficulties in calibrating the heat motor with respect to the actuating point of the load current switch for the energy input to the heat motor. Additionally, the known arrangements for such controllers have applied to the bias from the user rotated cam to one portion of the snap acting load current switch and have applied the bias from the heat motor bi-metal to another portion of the switch. This arrangement has resulted in difficulty in calibrating the controller to provide the desired duty cycle or ratio of "on" time to "off" time of the load heater being controlled and has diminished the repeatability of the switch when calibrated.

Furthermore, known arrangements for the user actuated cam to vary the bias on the load current switch have resulted in numerous parts, complexity and difficulty in calibrating the controller as to the position of the cam with respect to the desired fractional duty cycle of the load heater.

Referring to FIGS. 7 and 10, a known heater controller for domestic cooking ovens is shown wherein the user cam 1 causes a cam follower 2 having one end attached to a blade member 3 cantilevered from stationary structure which causes the cam follower to bias the blade spring 3 in an upward direction. A snap acting blade spring 4 is attached to the blade member 3; and, the spring 4 has a moveable contact 5 on one end thereof which is effective upon movement of the spring 4 for opening and closing against the stationary contact 6. The end of the blade spring 4 is biased downwardly at the end distal contact 5 by the end of a bi-metal member 7, which has attached thereto a heat motor indicated generally at 8, which comprises a relatively thin film resistor mounted on a ceramic substrate 9 with one end of the resistor connected electrically to a cantilevered contact strip 10 with the other distal end thereof contacted by a wiper 11 which is connected to one side of a power line through a cam actuated switch 12. The member 10 and the blade spring 3 are connected to a common member 13 which is connected to the opposite side of the power line from switch 12. A calibration screw 14 which is accessible through a hole in the housing 15 is provided for adjustment of the upright position of the bi-metal actuator 7.

FIG. 7 shows the electrical schematic for the device of FIG. 10 in which the heat motor 8 has one side connected through junction 16 to one side of the switch 12; and, the other side of the heat motor is connected to junction 17 which is connected through a cam actuated switch 18 to a junction 19 which is connected to the opposite side of the power line.

Junctions 16 and 18 are connected through load terminals H1, H2 to the heater load indicated at 22. Switch 12 includes the stationary contact 6 and the movable contact 5 as shown in FIG. 10. The prior art device of FIG. 7 includes a pilot lamp 24 connected through a terminal denoted P and through cam operated switch 20 to junction 19.

Referring to FIG. 8, another known heat motor actuated controller is shown schematically wherein a first and second electrical load heaters 25, 26 are connected in parallel with the second load heater 26 being series connected to the switch 18'.

FIG. 9 shows another known heat motor actuated directional duty cycle heater controller having a single load heater 27 series connected with the heat motor 8 "to the cam actuated switch 12". Heat motor 8 " acts on cam actuated switch 12"in the same manner as in the device of FIG. 7.

The known devices are complex in that many parts are required; in particular, the assembly of the members 8, 9, 7, 10, 13 and 3 in the FIG. 10 prior art device are noted as requiring riveting or weldment and are consequently difficult to assemble in the housing. In addition, the three piece structure of members 2, 3 and 4 is difficult to form as a sub-assembly and install in the housing.

Therefore, it has long been desired to find a way or means of providing a heat motor actuated duty cycle modulating controller for an electrical load such as an electrical resistance heater and to provide such a device which is simple to assemble, has a minimum of parts and is low in manufacturing costs and easy to calibrate is accurately repeatable when calibrated and reliable in operation over extended service life.

BRIEF SUMMARY OF THE INVENTION

It is an object of the present invention to provide a heat motor actuated controller for duty cycling the load current of an electrical load with a user selectable input for the fraction of the duty cycle in which the load current is "on".

It is a further object of the present invention to provide a controller for regulating the load current to an electrical load such as an electrical resistance heater and to provide user selection of the ratio of "on" time to "off" time in a easy to assembly device which has a minimum of parts and is low in manufacturing costs, accurately repeatable and reliable in service.

It is a further object of the present invention to provide a controller for duty cycle regulating an electrical load such as an oven heater with user input for selecting the percentage of duty cycle and which employs a heat motor for cycling the load current switch in the controller.

It is a further object of the present invention to provide a controller for duty cycle regulating an electrical resistance load with user selection of the percentage of duty cycle and which has the user input comprising a rotatable knob which operates a selector cam.

It is a further object of the present invention to provide an electrical controller having a user input knob which is axially assembled over the rotatable shaft and frictionally retained thereon by a spring formed as one piece with the shaft.

It is a further object of the present invention to provide a user variable duty cycle controller for regulating current to an electrical resistance load and employing a bi-metal member heated by a resistance heater with the user input rotating a cam which acts directly on the bi-metal actuator.

It is a further object of the present invention to provide a controller for duty cycle regulating an electrical resistance load where the heat motor is connected to a movable contact member having an integral snap spring formed therewith with the heat motor providing a force input to the snap spring at a location intermediate the ends of the moveable contact member.

The present invention utilizes a heat motor in the form of a relatively thin film resistor superposed on a rigid substrate and mounted on one leg of a generally U-shaped bi-metal member having end portions of the opposite leg of the U-shape operative upon heating of the bi-metal to apply a force to vary the bias on a snap acting load current switch. The load current switch has a movable arm member with a contact mounted on one end thereof and with the opposite end of the moveable arm member pivoted on the controller housing such that movement of the contact with respect to a stationary second contact effects making and breaking of the load current. The moveable arm member has integrally formed therewith as one piece a snap acting blade spring which has in one embodiment the free end thereof attached by weldment to the operative end portion of the bi-metal member such that movement of the bi-metal member moves the free end of the blade spring to change the trip point or snap over point of the switch.

In another embodiment of the heat motor sub-assembly, the moveable arm has a flexible portion of one end welded to the base; and, the integral blade spring free end registered for pivotal movement on the end of one leg of the bi-metal member thereby compressing the blade spring.

A user rotatable cam is operative to act on a bias spring connected to the bi-metal member which is connected to the blade spring of the load current switch. Rotation of the cam enables the user to deflect the bias spring and cause the blade spring to effect snap actuation of the load current switch and closing of the load current contacts. The heat motor resistor is energized upon closing of the load current contacts and begins heating the bi-metal. Warpage of the heated bi-metal overcomes the bias spring and moves the blade spring to effect de-actuation of the switch and opening of the contacts to thereby break the load current and also shut off the heat motor. Subsequent cooling of the bi-metal effects movement of the switch blade spring and effects snap-action of the switch to reclose the load current contacts and re-energize the heat motor thus resuming the cycle. The user operated cam thus enables selection of the ratio of load current "on" to "off" time by varying the preload or bias on the load current switch snap spring.

In one embodiment of the heat motor sub-assembly the bi-metal member is preassembled to the spring of the movable arm member and one end of the arm member is pivoted on a base member with an electrical terminal; and, the heat motor is positioned on the bi-metal member and the assemblage is clipped together with a permanently deformed clip thereby forming a heat motor and load switch sub-assembly. In one embodiment of the invention the heat motor sub-assembly has one leg of the bi-metal member secured to the base or support member; and, the moveable contact arm has one end thereof secured to the base member, the free end of the integral blade spring of the contact member bowed or compressed against another end of the bi-metal. The second embodiment is thus arranged such that the primary load current path from the contacts of the moveable member is the weld-enclosed end of the moveable member, rather than through the bi-metal member. This arrangement functions to prevent self-heating of the bi-metal member.

The electrical terminal of the base member is easily inserted in a housing for mounting the sub-assembly therein in a convenient manner. The sub-assembly of the bi-metal member, the movable contact member with integral blade spring and the base terminal member provides a heat motor actuator and snap-acting switch combination which minimizes the number of parts and permits pre-loading of the blade spring and assembly in a manner which is easy to perform in mass production and which minimizes the accumulation of tolerances with respect to assembly of the snap-acting blade mechanism.

The user rotated cam input to the bias spring and bi-metal member as opposed to portions of the snap-acting switch blade provides increased accuracy of setting of the bias on the switch to improve the ease and accuracy of varying the duty cycle of regulation of the load current.

In another aspect of the invention, the user rotated cam has a shaft extending therefrom outwardly of the controller housing which has an integrally formed deflectable spring portion so as to frictionally engage the user control knob when the knob is axially assembled onto the shaft.

In another aspect of the invention, the preassembly of the bi-metal, heater, movable contact member and base terminal member to form a sub-assembly facilitates installation in the controller housing. The force input from the user rotatable cam to bias spring and to the bi-metal member produces sufficient accuracy in the sub-assembly and stability of the snap-acting switch such that upon assembly into the housing, the calibration of the snap-acting load current switch with the cam may be accomplished merely by adjusting the position of the stationary contact for the load current switch.

The present invention thus provides a unique and novel controller for duty cycle regulating an electrical load current and employs a heat motor energized upon user rotation of a cam to close a load current switch. Concurrent energizing of the heat motor overcomes the bias on the load current switch; and, upon attainment of the desired percentage of time, de-actuates the load current switch cutting of the load current and the heat motor. Upon cooling of the heat motor, the cycle is repeated thereby modulating or regulating the load current at the desired fractional duty cycle. The invention employs a unique sub-assembly of the heat motor and snap-acting load current switch which minimizes the number of parts and improves the accuracy of the switch calibration and operation upon installation in the controller housing for making and breaking a circuit with an adjacent stationary contact. The user control knob is axially assembled over a cam shaft extending externally of the controller housing which shaft has an integrally formed spring frictionally engaging the knob for retaining the knob on the shaft.

BRIEF DESCRIPTION OF THE DRAWINGS

FIG. 9 is a schematic of another prior art device;

FIG. 10 is a view similar to FIG. 2 of the prior art device of FIG. 7;

FIG. 17 is a side view of the end portion of a user input knob shaft of the present invention;

FIG. 18 is a bottom view of the shaft of FIG. 17;

FIG. 19 is an enlarged end view of the shaft of FIG. 17;

FIG. 23 is a cross-section of shaft and knob of the embodiment of FIGS. 1*a* and 1*b;*

DETAILED DESCRIPTION OF THE INVENTION

Figure 1A:
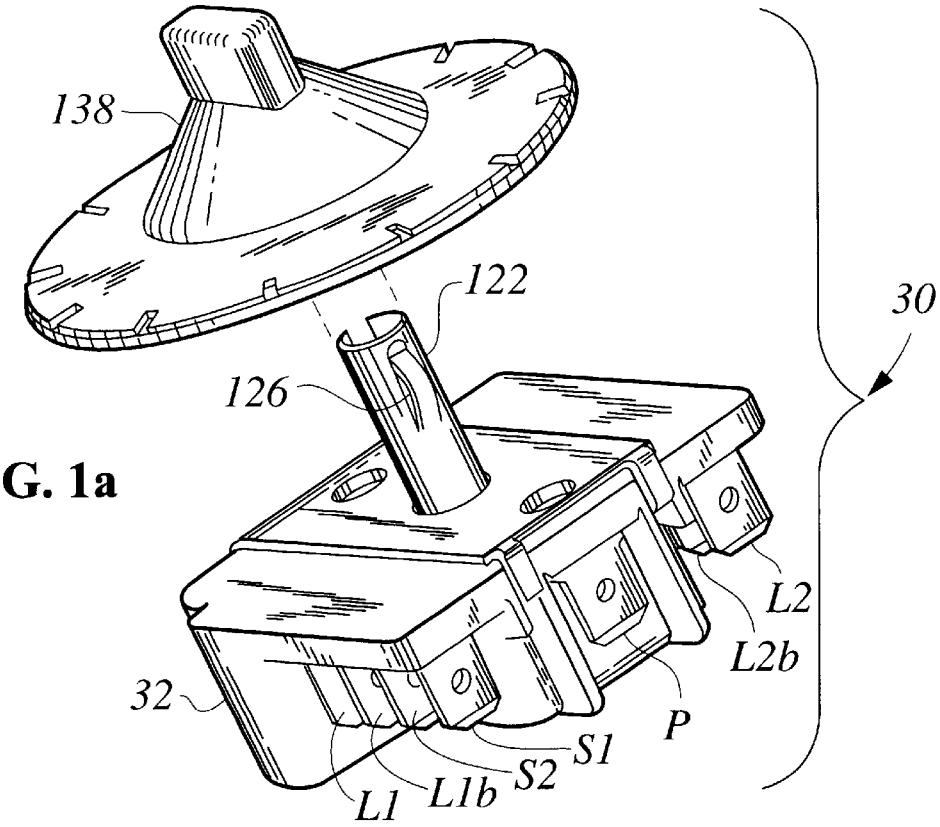
FIG. 1*a* is an axonometric view of the assembled controller of the present invention.

Referring to FIGS. 1*a*, 1*b*, 2, 3, 5 and 22, the controller of the present invention is indicated generally at 30 and has a housing 32 with a user rotated cam indicated generally at 34 journalled for rotation in the housing and which has a first or outer cam track 36 formed thereon. A second intermediate cam track 38 and a third smaller diameter cam track 40 formed thereon in axially spaced arrangement on the cam 34. The controller has a first heater load connecting terminal H1 which is integrally formed with a switch support or base member 42 which serves to support the moveable parts of the load current switch as will hereinafter be described. A second load heater connector terminal H2 is mounted on the housing and has attached thereto a stationary contact 44 which forms one side of a second switch indicated generally at 46.

A first power line connector terminal L1 has attached thereto a secondary line connector terminal L1b and also a stationary contact 48 which forms one side of a load current switch indicated generally at 50. A second line power terminal L2 and an auxiliary second line terminal L2b are provided with the terminal L2b having a stationary contact 52 provided thereon which forms one side of a third switch indicated generally at 54.

An auxiliary set of connector terminals S1, S2 are provided with S1 having connected thereto a blade arm 56 which has attached to the end thereof a moveable contact 58; and, terminal S2 has connected thereto a stationary contact 60 which forms one side of a fourth switch indicated generally at 62 with the moveable contact 58 forming the other side thereof. The blade arm 56 is curved to form a cam follower for following the cam track 38 of cam 34. The switch 62 is an auxiliary function switch may be connected through terminals S1, S2 for any desired auxiliary function.

A pilot connecting terminal P has connected thereto a blade arm 66 which has a moveable contact 68 provided on the free end thereof which forms one side of second switch 46.

Blade arm 66 has a second blade arm 69 attached to or formed integrally with the free end of arm 66. The second blade arm 69 extends in cantilever from arm 66 and toward switch 54; and, second arm 69 has a moveable contact 64 provided on the free end thereof which forms one side of switch 54. The second blade arm 69 has a cam follower 67 formed thereon which follows cam track 40 of cam 34. Upon user rotation of the cam 34, track 40 sequentially closes first switch 46 and then switch 54. Upon the cam follower 67 being raised to the greater diameter surface of track 40 and upon the cam follower 67 dropping into the notch of cam track 40, the switches 54, 46 open in reverse order of closing.

The load current switch 50 comprises a sub-assembly indicated generally at 70 which includes a moveable arm 72 pivoted on the base member 42 as will hereinafter be described at one end thereof and having a moveable contact 74 formed on the opposite or free end thereof and which forms one side of the load current switch 50. A bias spring 79 has one end anchored and the other end contacting a portion of the sub-assembly 70 as will hereinafter be described; and, bias spring 79 has formed thereon a cam follower 77 which is operative to follow cam track 36 on the cam 34.

Figure 1B:
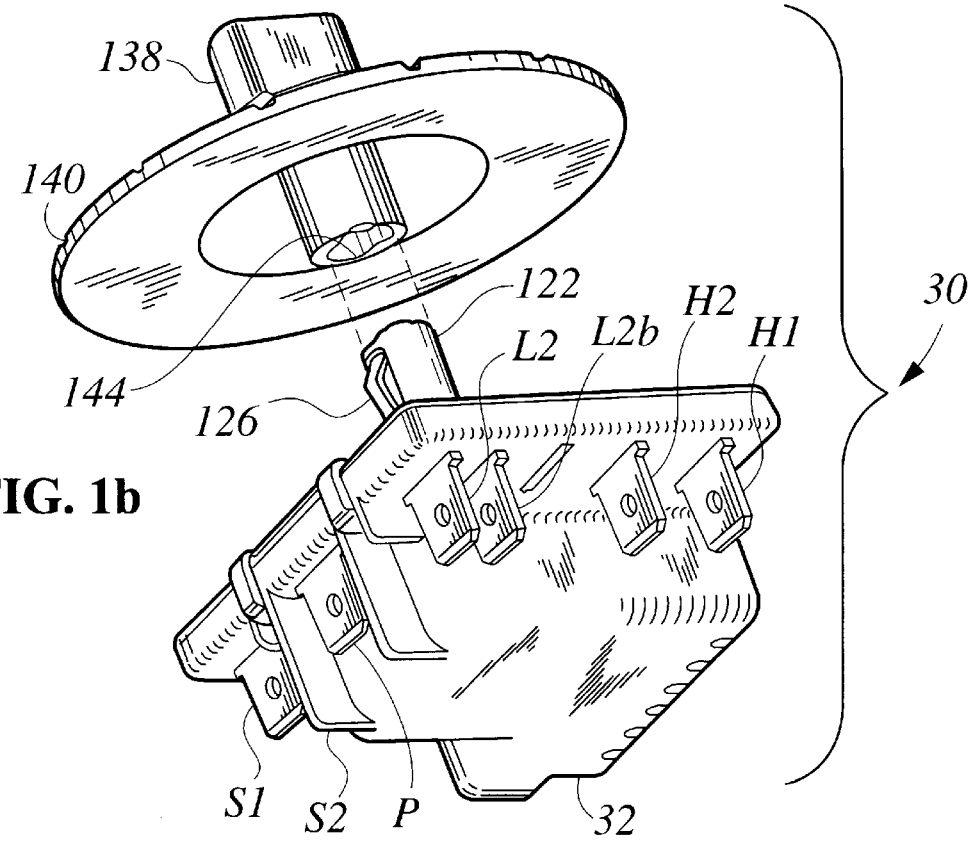
FIG. 1*b* is a view similar to FIG. looking at the controller from backside.

It will be understood that each of the connector terminals L1, L1b, S1, S2, H1, H2, L2, L2b and P extends through slots such as slot 81 for terminal L2 in housing 32 and extend outwardly from the rear face of housing 32 as shown in FIGS. 1*a* and 1*b*.

Figure 4A:
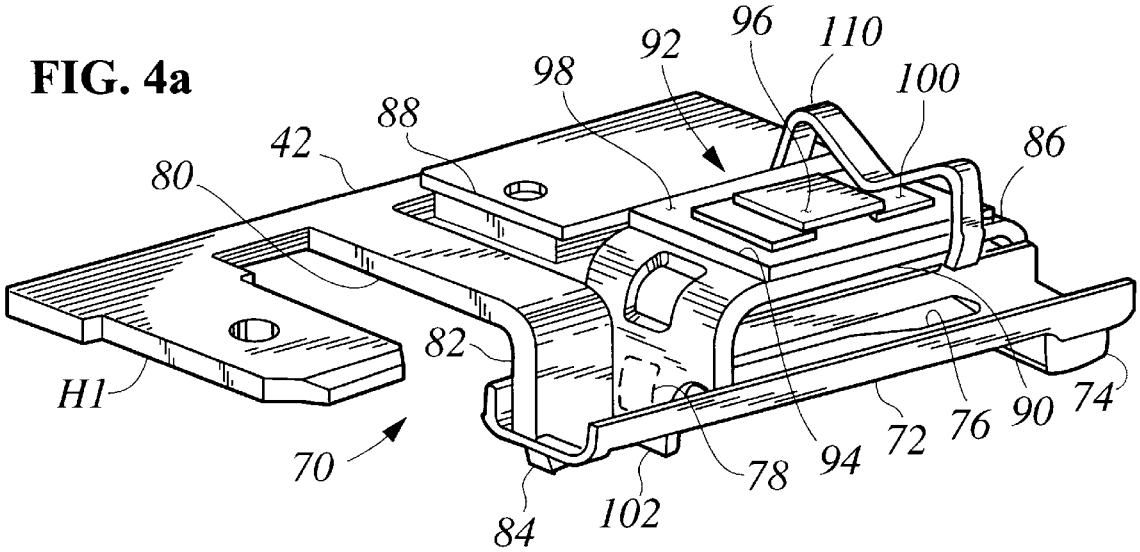
FIG. 4*a* is an axonometric view of the sub-assembly of the heat motor, movable switch member and base terminal member.
Figure 4B:
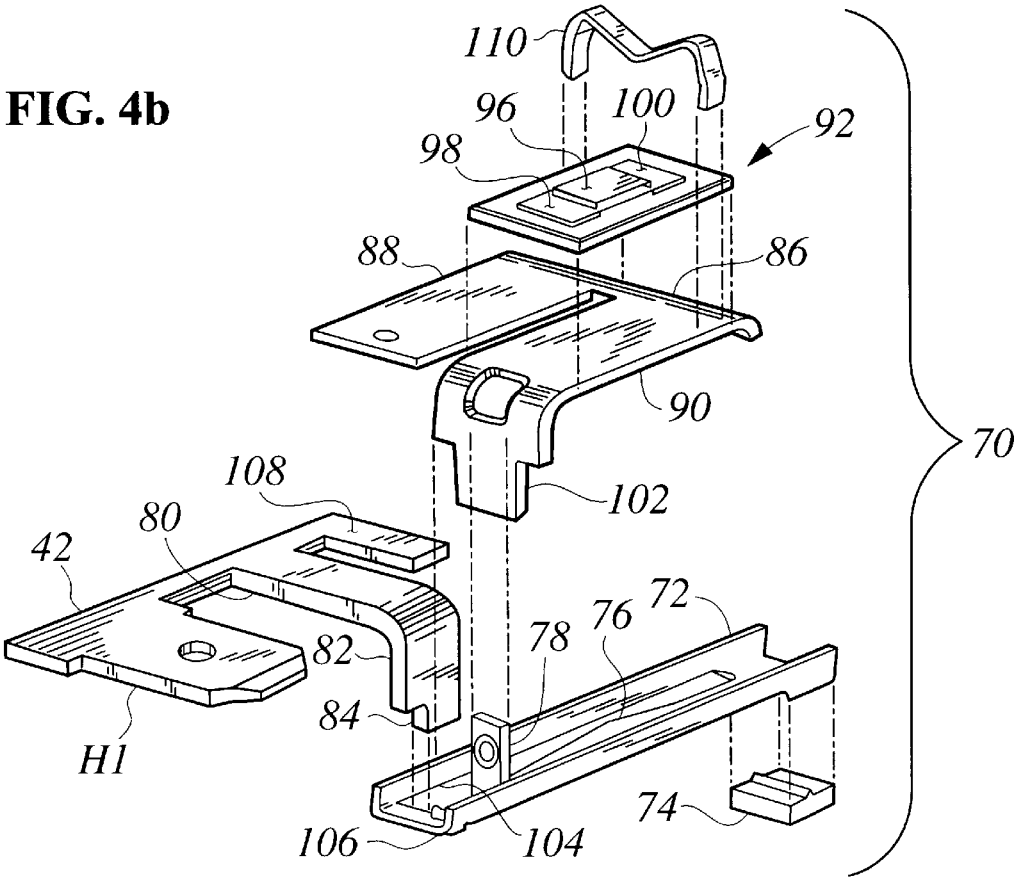
FIG. 4*b* is an exploded view of the sub-assembly of FIG. 4*a;*
Figure 5:
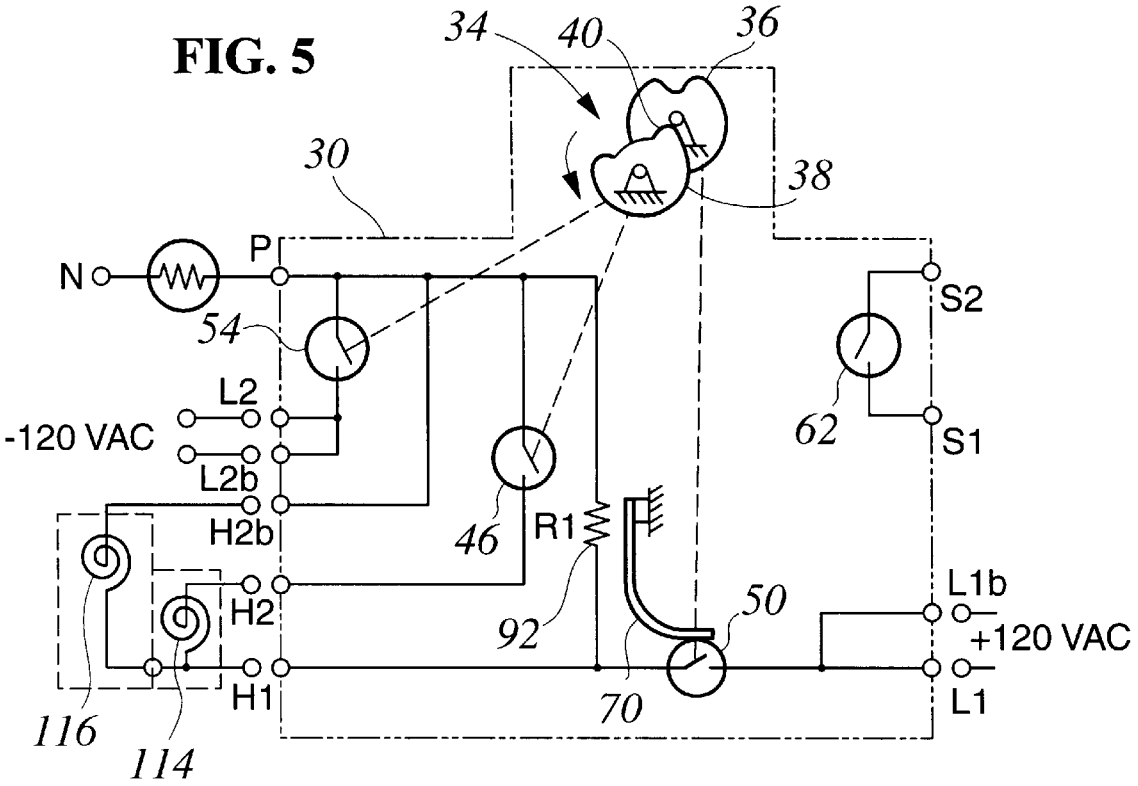
FIG. 5 is an electrical schematic of an embodiment of the invention with a pilot light and auxiliary load switch.

Referring to FIGS. 4*a* and 4*b*, the sub-assembly 70 includes the moveable arm member 72 with moveable contact 74 attached to one end thereof and which is operable for making and breaking the load current against stationary contact 48. The moveable arm 72 has integrally formed therewith as one piece an elongated blade spring 76 and which extends in cantilever from the end adjacent contact 74 and has the free end 78 thereof formed at right angles to the direction of elongation.

The base or support member 42 has an arm 80 formed preferably integrally thereon which extends preferably in spaced parallel relationship to the integrally formed connector terminal H1, which arm 80 has the end 82 thereof formed at right angles thereto and provided with a registration surface in the form of a notch or shoulder 84 which functions as will be described hereinafter. It will be understood that member 42 is preferably formed as one piece with arm 80, end 82 and terminal H1.

A bi-metal member indicated at 86 is formed of flat plate or sheet stock and has in plan form a generally U-shaped or bifurcated configuration with one leg 88 thereof forming a temperature compensating portion; and, the opposite leg 90 forms an active leg and part of a heat motor indicated generally at 92. Heat motor 92 includes bi-metal arm 90, an insulating, preferably ceramic, substrate 94 with a relatively thin resistive strip 96 mounted on the surface of the substrate 94. The resistive strip 96 has end conductive pads 98, 100 provided in association therewith on the surface of the substrate 94.

The active bi-metal arm 90 has the free end thereof formed downwardly at right angles thereto as denoted by reference numeral 102 and is sized to interfit the cutout 104 in the contact arm 72 from which the blade spring 76 is stamped.

The sub-assembly 70 is assembled by first attaching the contact 74 to the end of arm 72 which is preferably accomplished by suitable weldment such as brazing or resistance welding or any other suitable expedient. The next step is the attachment of bi-metal end tab 102 to the end 78 of the switch blade spring which in the presently preferred practice is accomplished by weldment.

With suitable fixtures (not shown) clamping bi-metal arm 88 to leg 108 of the base, the arm 88 of the bi-metal is secured to leg 108 by a suitable expedient such as weldment and the unshown fixtures removed.

The end 106 of cutout 104 of moveable contact arm 72 is then assembled onto the notch 84 formed in end portion 82 of arm 80 of base 42; and, the leg 88 of the bi-metal is fixture upon a third arm portion 108 of base 42 such that tension is introduced to the member 72. Alternatively legs 80 and 10 of base 42 may be formed as one extension thereof. The blade spring 76 is thus placed in longitudinal compression with the end 106 of the arm pivoting in notch 84. Blade spring thus provides a snap action to the pivotal movement of arm 72.

The next step in the fabrication of sub-assembly 70 is the attachment of the resistor 96 and conductive tabs 98, 100 to the substrate 94; and, the preassembly thereof is then attached to the surface of leg 90 of the bi-metal by a clip 110 in a manner as will be described. Alternatively, heat motor 92 may be assembled prior to attachment of end 106 of contact arm 72 to notch 84 of the end 82 of leg 80 of base 42.

Figure 11:
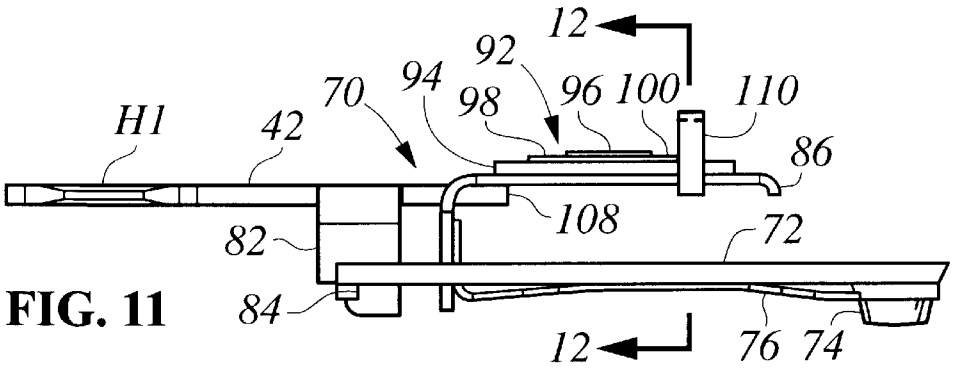
FIG. 11 is a side view of the sub-assembly of FIG. 3 upon initiation of assembly.
Figure 12:
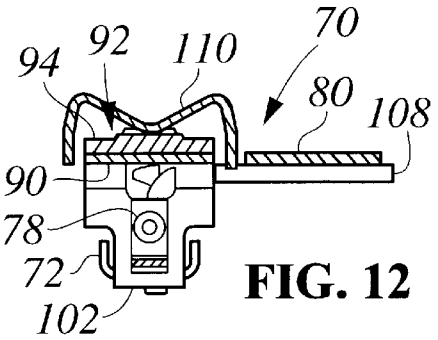
FIG. 12 is a section view taken along section indicating lines 12—12 in FIG. 11.

Referring to FIGS. 11 through 16, the assembly of the heat motor 92 is illustrated wherein the initial step is shown in FIGS. 11, 12 and includes positioning the preassembly of the substrate and resistor onto the arm 90 and positioning the clip 110 thereover.

Figure 13:
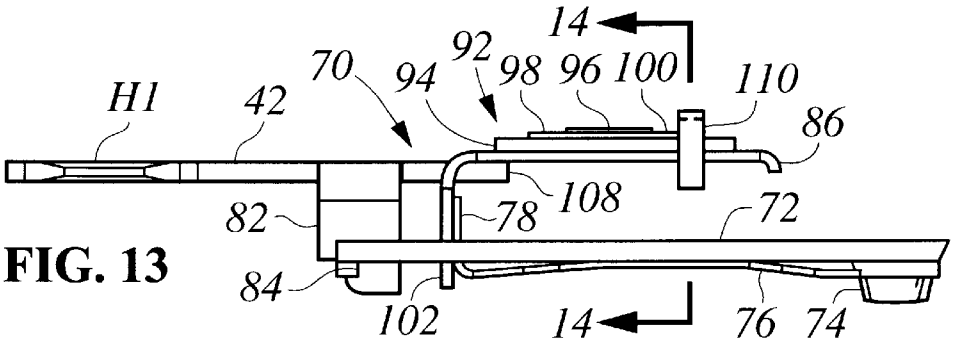
FIG. 13 is a view similar to FIG. 11 of the second stage of assembly.
Figure 14:
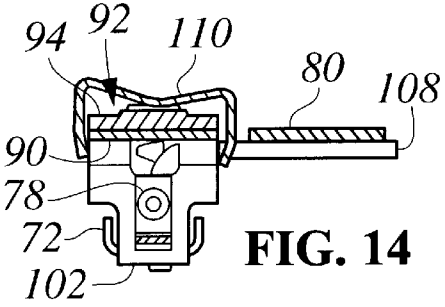
FIG. 14 is a section view taken along section indicating lines 14—14 in FIG. 13.

Referring to FIGS. 13, 14, the next step in the sequence is the downward movement of the sides of clip 110 to the position shown in FIGS. 13 and 14. It will be understood that this movement of the clip 110 is accomplished by supporting the members and suitable fixtures (not shown) and by the use of suitable forming tools (not shown), the details of which have been omitted for the sake of brevity.

Figure 15:
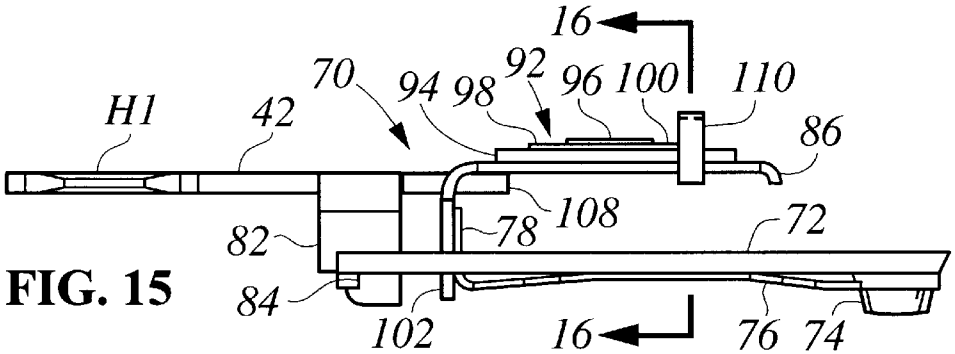
FIG. 15 is a view similar to FIG. 13 of the final stage of assembly.
Figure 16:
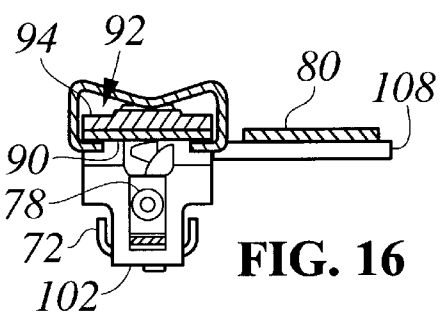
FIG. 16 is a section view taken along section indicating lines 16—16 in FIG. 15.

Referring to FIGS. 15, 16 the final step of the assembly of the heat motor 92 is shown wherein the ends of the clip 110 have been folded under the arm 90 of the bi-metal to secure the substrate, with the resistor and pads 98, 100 thereon, to the arm 90.

Figure 2:
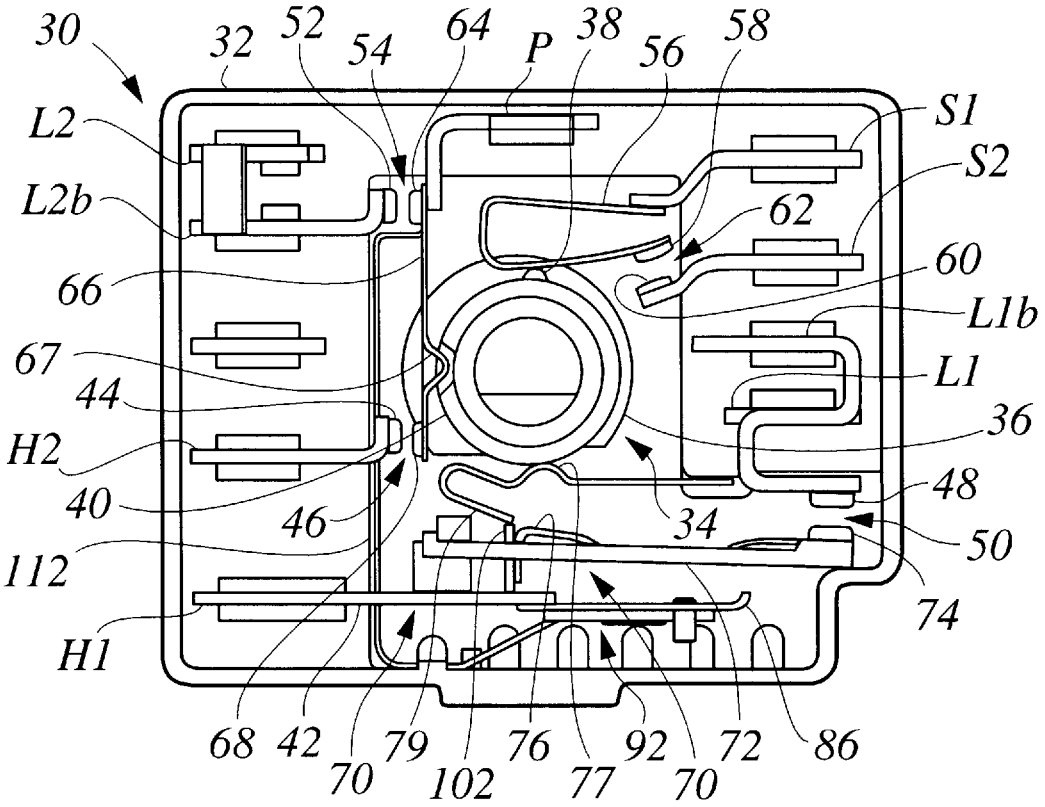
FIG. 2 is a view of the controller of FIG. 1 with the cover removed with the user cam in the "off" position and the load current switch open.
Figure 3:
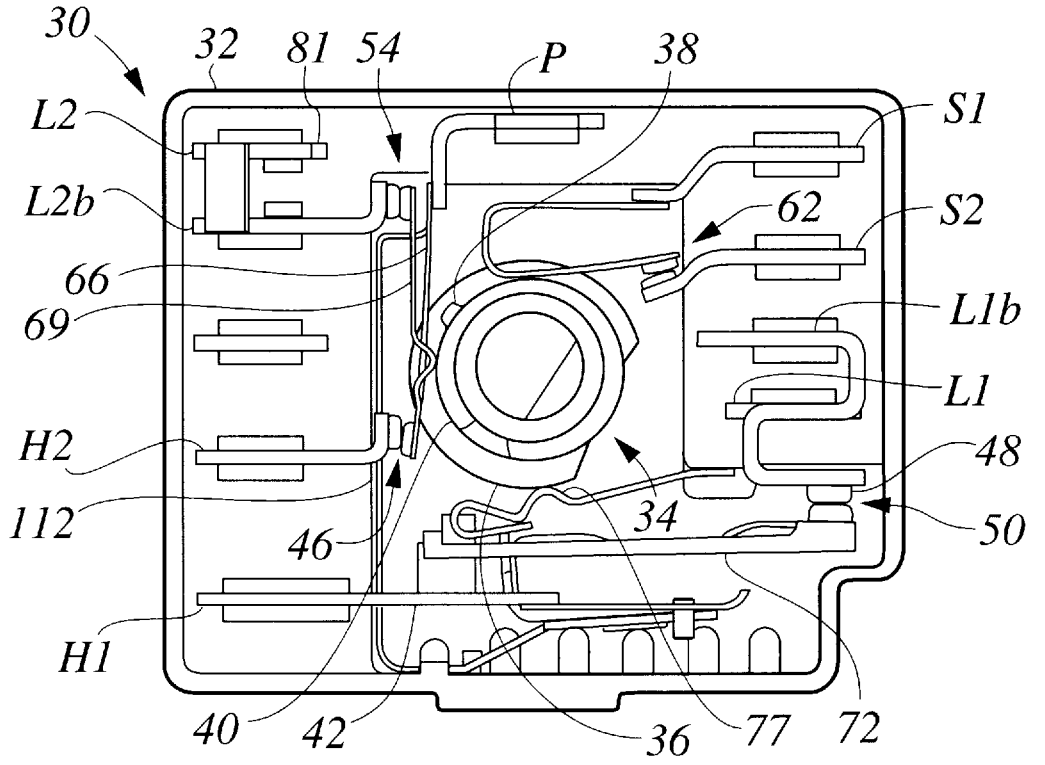
FIG. 3 is a view similar to FIG. 2 with the load current switch closed by rotation of the user cam.

Referring to FIGS. 2 and 3, a conductive strip 112 is attached to terminal P and extends to make surface contact with one of the pads 98 on the heat motor 92 to provide electrical current flow thereto. The conductive pad 100 on opposite end of the resistor 96 is electrically connected by surface contact with central portion of clip 110 to the bi-metal arm 90 and through the blade spring 76 to contact 74 which, upon closing against stationary contact 48 of line connector L1 provides power to the heat motor 92. Thus, upon closure of the third switch 54, power is supplied from line connector L2 through switch 54, strip 112, through pad 98, resistor 96, pad 100, clip 110 and moveable arm 72 and contact 74 to contact 48 and the opposite side of the power line through terminal L1.

In the present practice of the invention, a first load heater 114 is connected across connector terminals H1, H2; and, a second load heater 116 is connected across connector terminals H1, H2b. The heaters 116, 114 may be either oven heating elements or surface heating elements as typically found on the top of a domestic cooking range.

In operation, user rotation of the cam 34 first closes switch 46 as shown in FIG. 3 by deflection of the connector member 66 and then further rotation deflects blade arm 69 attached to the end of member 66 and sequentially closes switch 54. The closing of switch 46 connects load heater 114 to the neutral, which is typically ground in a three wire 240 Volt system, thus arming the heater 114 subject to the state of switch 50. Closure of switch 54 connects the heaters 114, 116 to the opposite side of the 240 V power line thereby applying full voltage to the heaters 114, 116 subject to the state of switch 50. User rotation of the cam 34 to the desired position as would typically be indicated on a dial or by indicia on the user control knob to the desired indicated temperature setting, causes cam track 36 to apply the pre-calibrated amount of deflection to bias spring 77. This deflection of cam follower 77 causes the end 79 thereof to move the end 102 of the bi-metal and the blade spring 76 downwardly through the center of member 72 and effect a snap action of the member 72 about the notch 84 which causes contact 74 to close against contact 48 thereby closing switch 50. Closure of switch 50, as previously described, energizes heat motor 92 which warps the bi-metal arm 90 after a predetermined amount of heat transfer to the bi-metal arm 90, which warpage overcomes the bias of the spring 79 and moves the blade spring 76 upwardly causing a reverse snap action and reopening of the contacts 50. This breaks the flow of current to the heat motor 92 and also the load current through connector H1. When the bi-metal has cooled sufficiently, the bias of spring 79 is again operative to reclose contacts of switch 50. The user positioning of cam track 36 to vary the bias of spring 79 against the spring 76 thus determines the ratio of the time the switch 50 is open as compared to the time the switch is closed thus varying the duty cycle of the flow of load current through terminal H1. In calibrating the controller of the present invention, the snap point of switch 50 is adjusted by bending the portion of L1 supporting stationary contact 48.

Arm 88 of bi-metal member 86 provides ambient temperature compensation of the position of the end 102 of arm 90.

Figure 6:
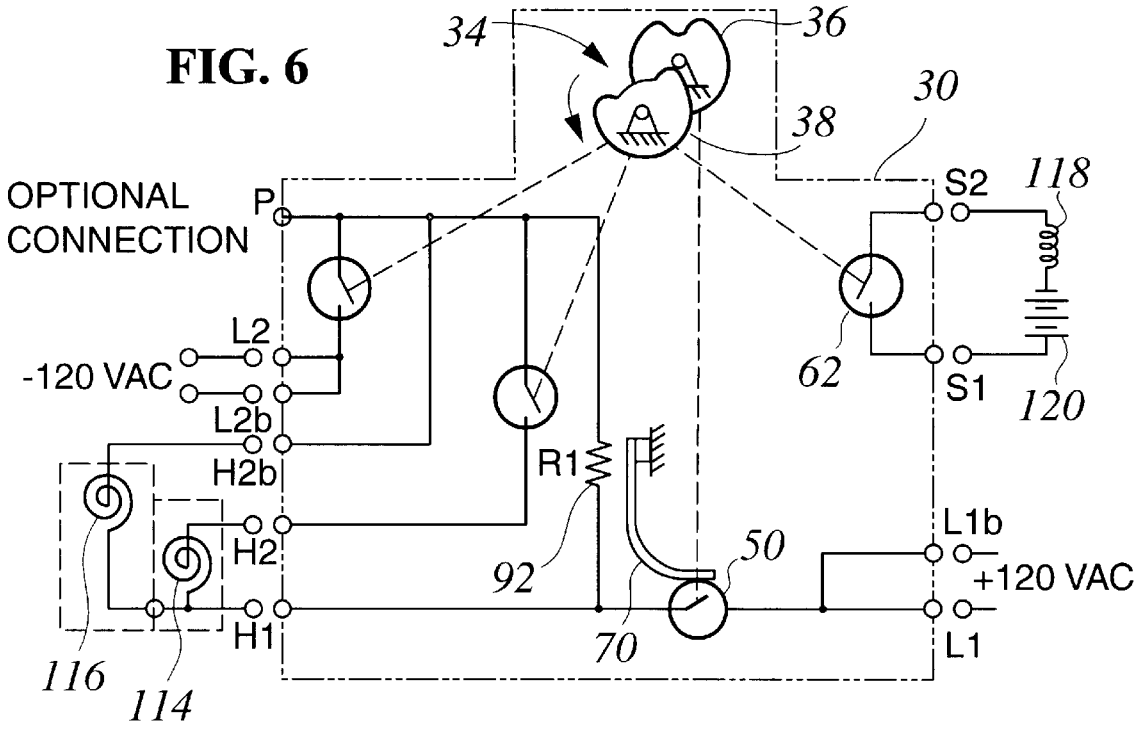
FIG. 6 is a schematic similar to FIG. 5 of an alternate arrangement.
Figure 7:
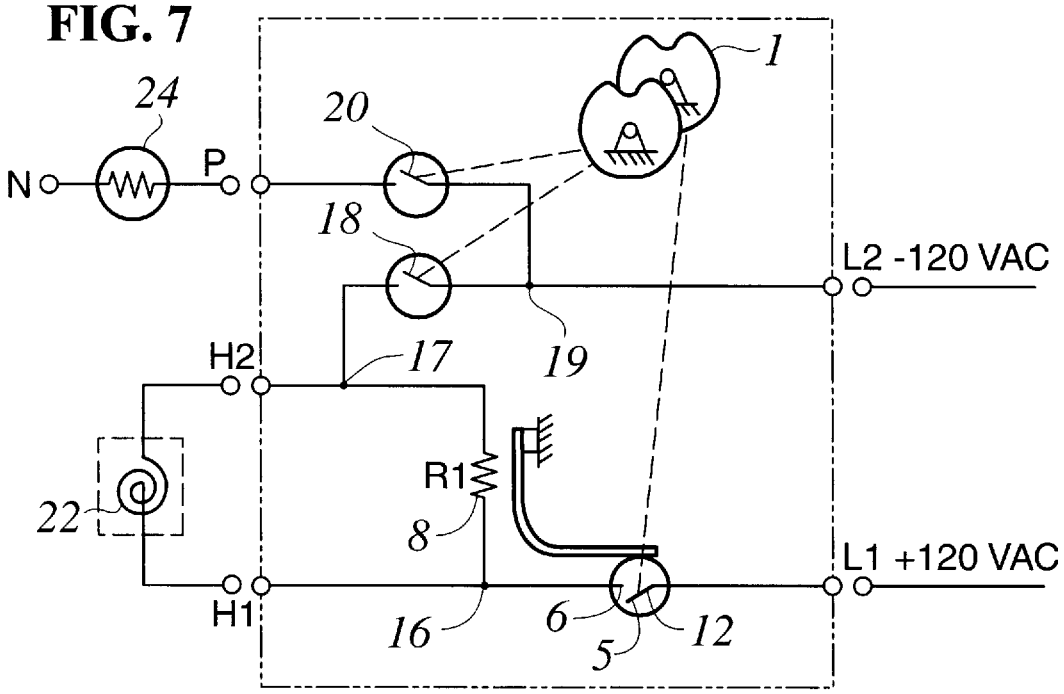
PRIOR ART FIG. 7
FIG. 7 is a schematic of a prior art device.
Figure 8:
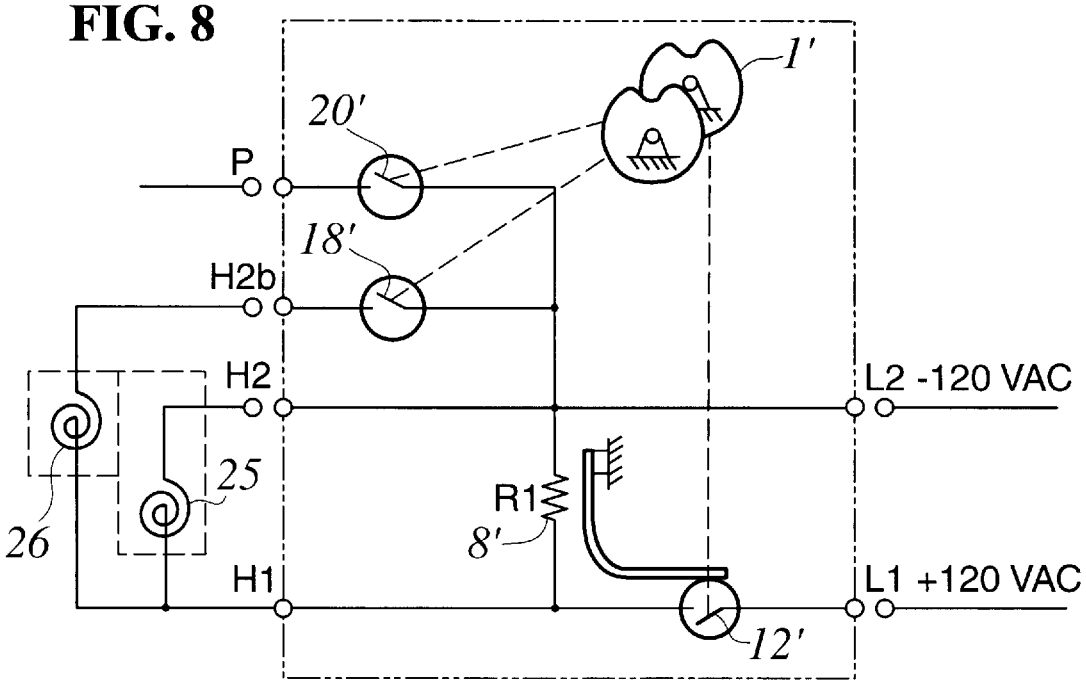
PRIOR ART FIG. 8
FIG. 8 is a schematic of another prior art device.

Referring to FIG. 6, an alternative embodiment of the invention is shown wherein an auxiliary load 118 is connected to a power supply 120 and is controlled by switch 58. In the embodiment of FIG. 6, the pilot light has been eliminated and the terminal P is available for other uses. It will be understood that the operation of the system of FIG. 6 is otherwise identical to that of FIG. 5.

Referring to FIGS. 1*a*, 1*b*, 17, 18, 19, 22 and 23 another aspect of the invention is illustrated wherein shaft 122 which is configured to have one end 125 received in the bore 124 of cam 34 and drivingly engaged therein in any suitable manner. Shaft 122 has thereon, distal end 125, an integrally formed spring member 126 provided thereon which is radially deflectable to the position shown in dashed outline in FIG. 19 through the slot 128 formed in the shaft upon assembly of user control knob 138 thereover. Knob 138 has an enlarged diameter flange 140 which may have position indicia 142 thereon to facilitate user selection of a desired temperature, which is pre-calibrated with the rotary position of the knob 138. Knob 138 also has a bore 144 formed on the underside thereof as shown in FIG. 1*b*. Bore 144 is configured to drivingly engage the end of shaft 122. The knob 138 is frictionally retained on the shaft 122 by the deflection of spring 126. In the embodiment of FIGS. 17 through 19, the shaft is formed of sheet stock which is roll formed in a generally C-shaped configuration in transverse section as shown in FIG. 19. If desired, a limit stop 146 may be formed on shaft 122 to limit axial insertion into cam bore 124. Stop 146 may also facilitate a requirement for axial displacement of the shaft prior to engagement, e.g., pull-to-turn.

Figure 20:
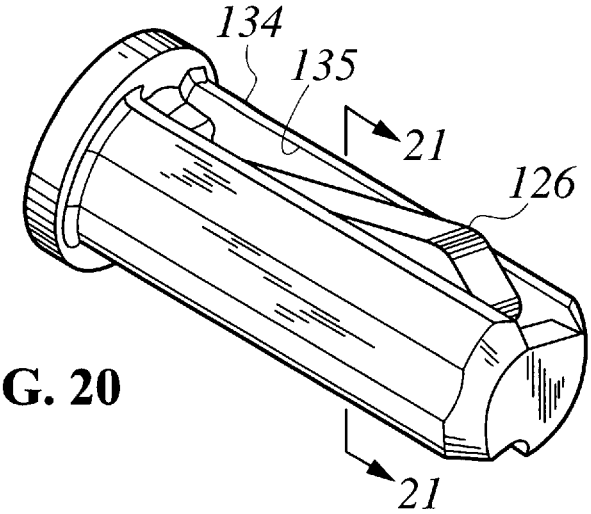
FIG. 20 is an axonometric view of an alternative embodiment of the user input shaft.
Figure 21:
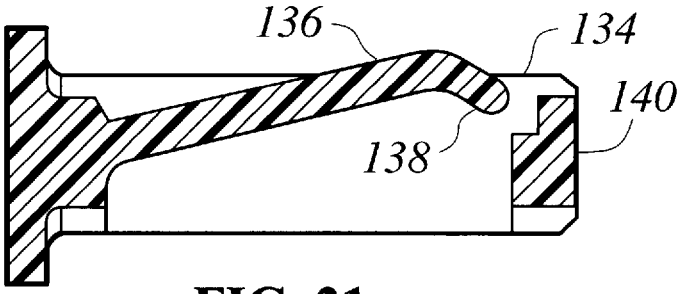
FIG. 21 is an enlarged section view taken along section indicating lines 21—21 of FIG. 20.
Figure 22:
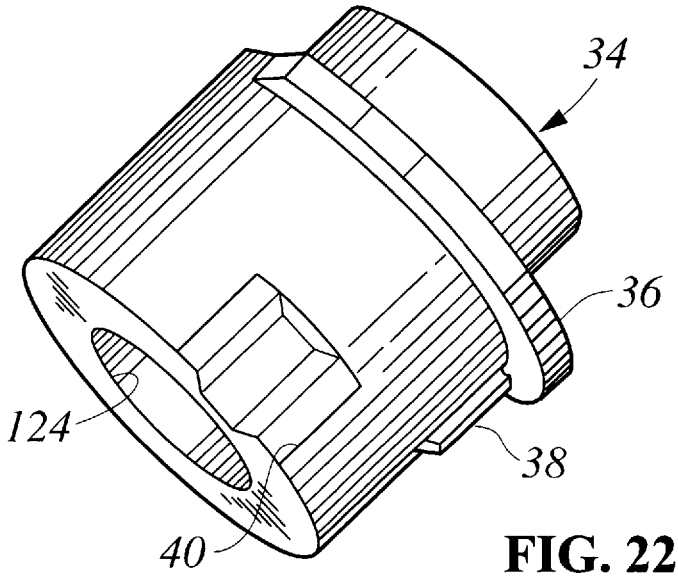
FIG. 22 is an axonometric view of the user rotatable cam.

Referring to FIGS. 20 and 21, another embodiment of the shaft 134 is formed integrally as one piece of plastic material and has a longitudinally or axially extending slot 135 which extends transversely through the shaft and has formed therein a cantilevered spring member 136 which in its free position has a portion thereof extending radially outwardly of the surface of the shaft. Upon assembly of the shaft 134 into knob bore 144, spring 136 is deflected radially downwardly until the free end 138 thereof registers against a notch 140 provided in the transverse end of the slot to thereby stiffen the spring and frictionally retain the cam thereon.

Referring to FIGS. 24 through 27, another embodiment of the invention is indicated generally at 200 wherein the general electrical arrangement of the load regulating assembly is similar to that of the embodiment of FIGS. 2 and 3 wherein like electrical terminal connections have been given the same reference designation for the sake of brevity of description. The embodiment 200 has a casing or housing 202 with electrical connecting terminals L2, P, L2b, H2, H1, L1b and L1 extending therethrough in an arrangement similar to the correspondingly denoted terminals in the embodiment of FIG. 2. Terminals L1b and L1 have connected thereto a stationary load carrying contact 204.

The contact arm of a heat motor sub-assembly indicated generally at 207 has a moveable load carrying contact 206 provided thereon for opening and closing against the stationary contact 204 for switching load current to a heater connected through terminals L1 and H1.

A user operated cam indicated generally at 208 is rotatably mounted on casing 202 and has portions thereof (not shown) extending externally of the casing 202 to enable user rotation of the cam 208 in a manner similar to that of the embodiment of FIGS. 1*a* and 1*b*. Cam 208 is effective to move a moveable switch member 210 which has a cam follower 212 formed thereon which follows a cam track 214 provided on the cam 208. Switch member 210 has a pair of spaced moveable switch contacts 216, 218 provided thereon disposed at opposite ends thereof for respectively closing against stationary contacts 220, 222 attached to the connecting terminals H1, L2b respectively. Member 210 is connected by a blade arm 213 (see FIGS. 25, 26, 27) to conductive supporting strip 211 which is also connected to sub-assembly 207. It will be understood that switch member 210 functions in a manner identical to member 66 of the FIG. 2 and FIG. 3 embodiment. It will be understood that the switches 224, 226 are sequenced and act in the same manner as switches 54, 46 of the embodiment of FIG. 2.

Figure 24:
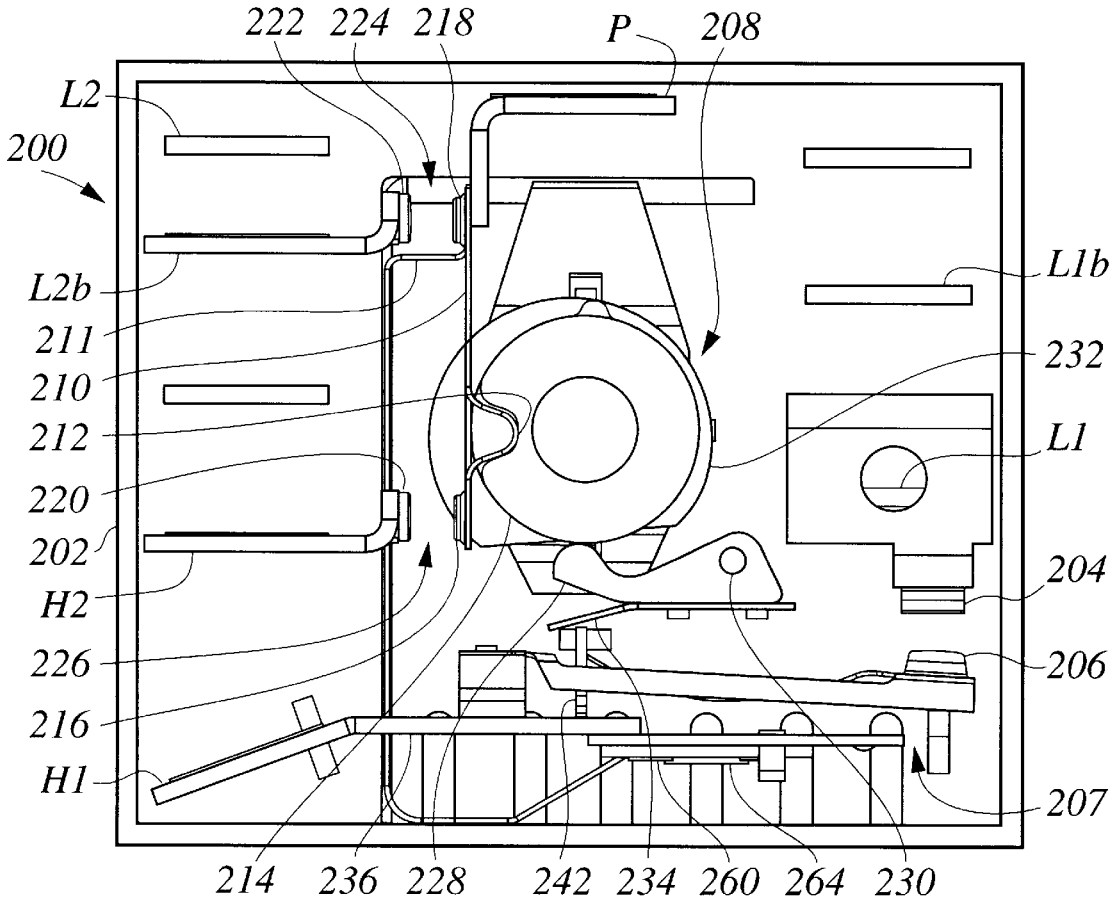
FIG. 24 is a view similar to FIG. 2 of an alternate embodiment of the invention with the user cam in the "OFF" position.

Cam 208 is shown in a position in FIG. 24 in which cam track 214 has allowed follower 212 on member 210 to completely open the contact pairs 218, 222 which comprise a switch indicated generally at 224 formed at one end of member 210 and also open the contact pair 216, 220 which comprises a switch indicated generally at 226 formed at the opposite end of member 210.

A second cam follower 228 is disposed for pivotal movement about a pin 230 anchored to casing 202 which follower tracks a second cam track 232 provided on the cam 208. Follower 228 has a flat blade spring member 234 attached thereto the end of which is bent outwardly and contacts a portion of sub-assembly 207. Spring member 234 maintains the follower in contact with the track 232 and resiliently absorbs movement of the follower for a portion of the stroke as will hereinafter be described. The end of spring 234 contacts the follower after absorbing some movement and thereafter "bottoms out" on the follower and thereafter transmits all the lift of the cam track 232 to sub-assembly 207.

Figure 25:
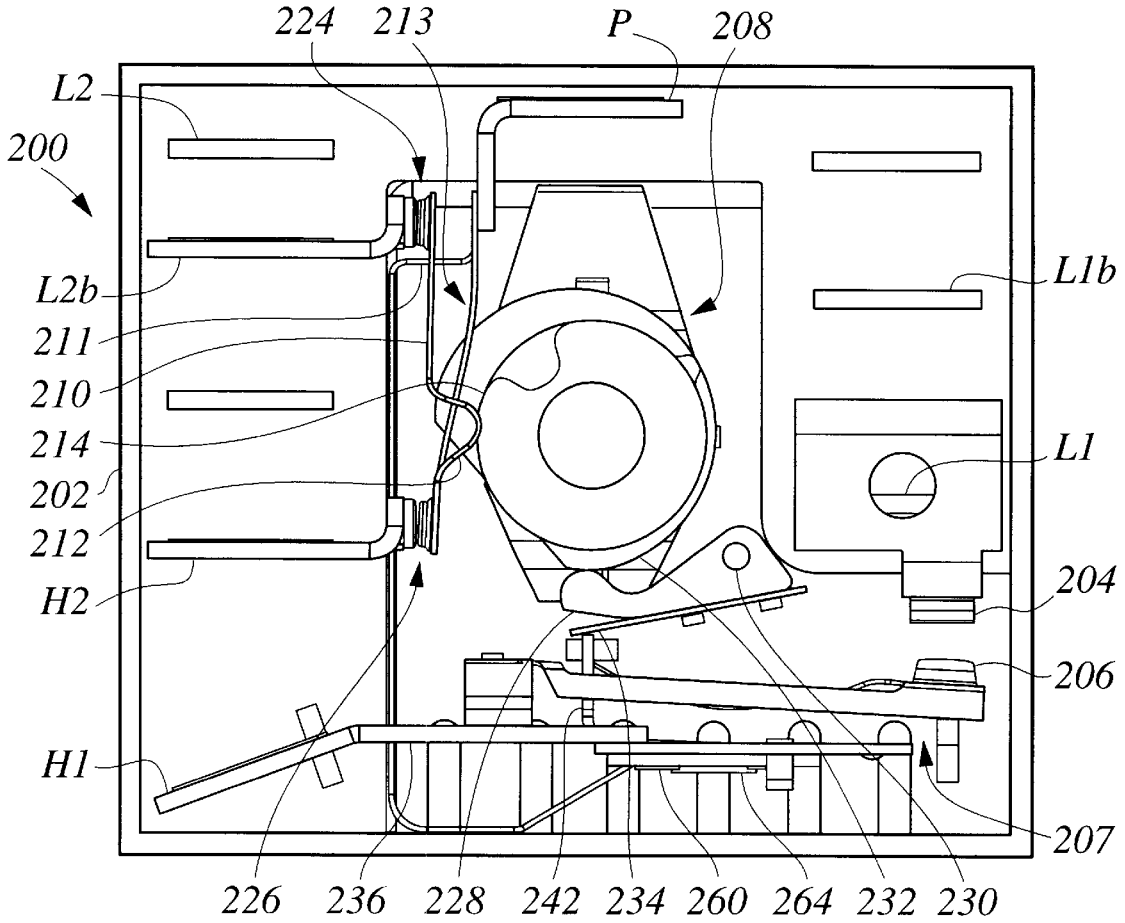
FIG. 25 is a view similar to FIG. 24 with the user cam in the "SIMMER" position with the load switching contacts open.

Referring to FIG. 25, the assembly 200 of FIG. 24 is shown with the cam 208 rotated in a clockwise direction approximately one-eighth turn from the FIG. 24 position wherein cam track 214 has raised follower 212 and member 210 to close switches 224, 226; and, cam 232 has raised follower 228 to cause spring 232 to be partially deflected and to apply a downward bias on the heat motor assembly 207. The position of the cam 208 in FIG. 25 represents a very low duty cycle "ON" time for the load switch contacts 204, 206 inasmuch as a light preload is applied to the heat motor sub-assembly 207 by blade spring 232. It will be understood that the heat motor 207 functions over all in a manner identical to that of the heat motor sub-assembly 70 with contacts 204, 206 corresponding to contacts 48, 74 switch 50 of the embodiment of FIG. 2. The low duty cycle position of the cam 208 of FIG. 25 is conveniently utilized for a "SIMMER" mode of operation for the heater connected to the load contacts 204, 206 through terminal L1.

Figure 26:
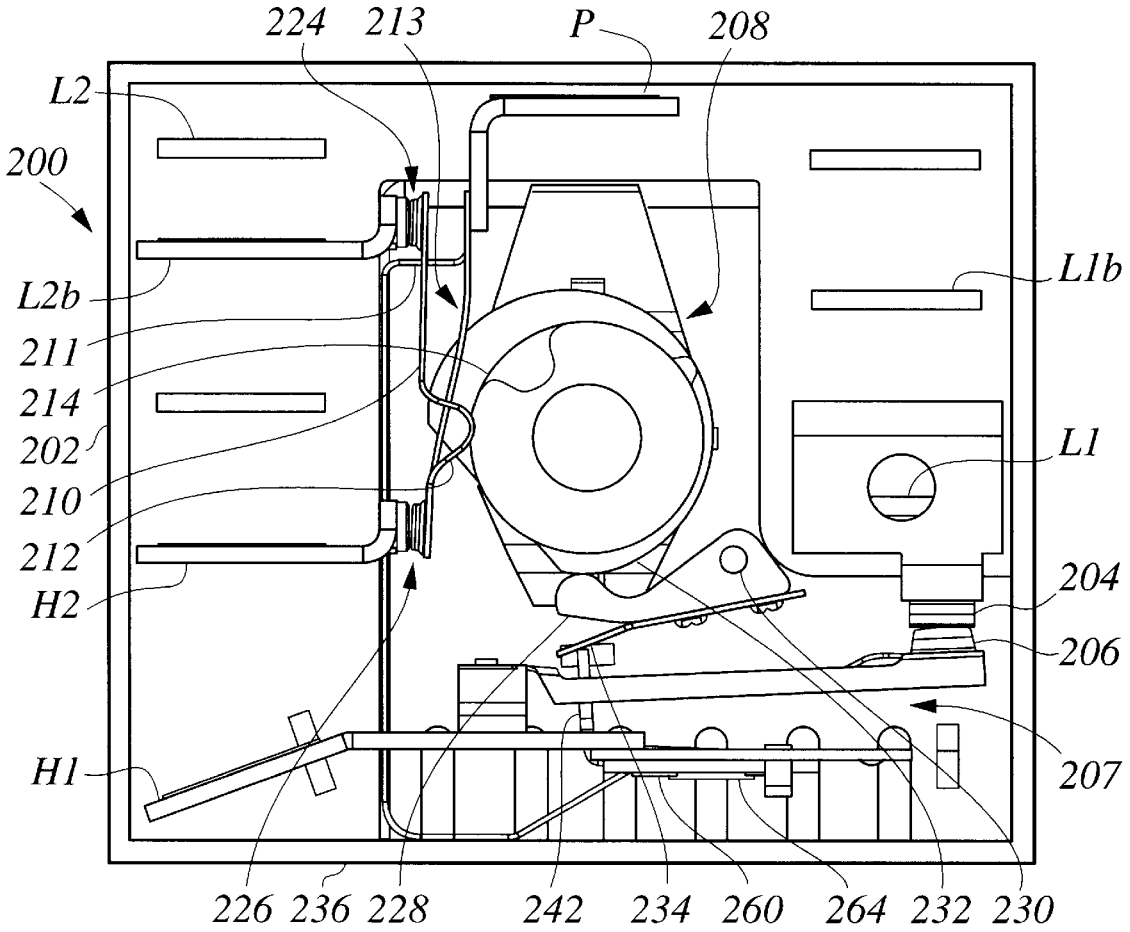
FIG. 26 is a view similar to FIG. 24 with the user cam in the "SIMMER" position with the load contacts closed.

Referring to FIG. 26 the assembly 200 is shown in the condition with the cam 208 positioned as in FIG. 25, but with the heat motor sub-assembly 207 having operatively effected closure of the load contacts 204, 206 by warpage of the bi-metal element thereof as will be hereinafter described.

Figure 27:
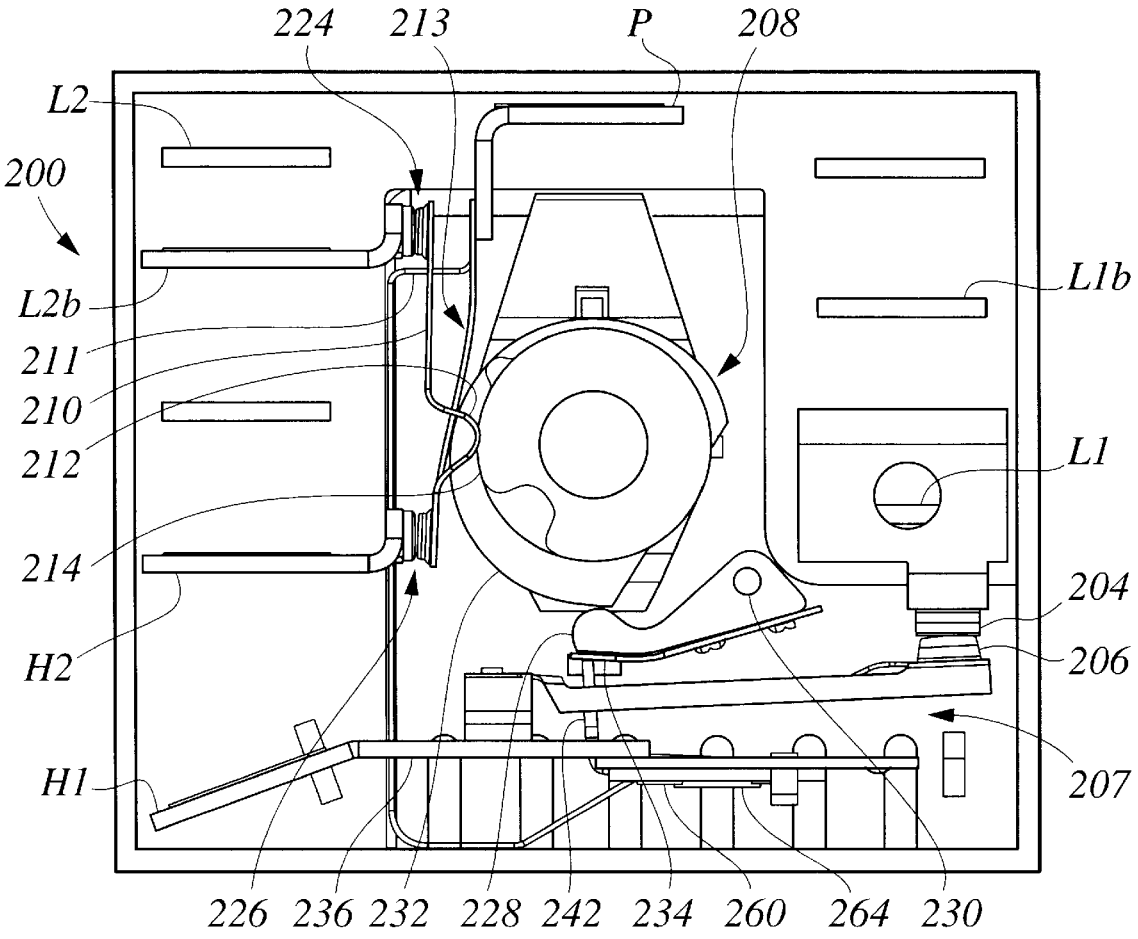
FIG. 27 is a view similar to FIG. 24 with the user cam in the "HIGH" position with the load contacts closed.

Referring to FIG. 27, the cam 208 has been rotated in a clockwise direction by an amount of 225° from the position shown in FIG. 26, or by an amount 315° from the position shown in FIG. 24, in which position the cam track 232 has lifted follower 228 sufficiently to cause blade spring 234 to "bottom out" against the follower and apply sufficient force to the heat motor sub-assembly 207 to cause the contact 206 to be snapped to the closed position against stationary contact 204. It will be understood that other cam profiles and angular arrangements may be employed for the cam 208; and the particular arrangement described and shown herein is intended as only by way of example. The position of the cam 208 shown in FIG. 27 represents the "HIGH" mode of operation for the duty cycle of the load contacts 204, 206. With the cam 208 in the position shown in FIG. 27, the duty cycle or "ON" time for the load current through contacts 204, 206 is at a maximum. Wherein cam follower 228 has been moved sufficiently to cause overtravel of bi-metal member 242 effectively preventing the heat motor 207 from re-opening the contacts 204, 206.

Figure 28:
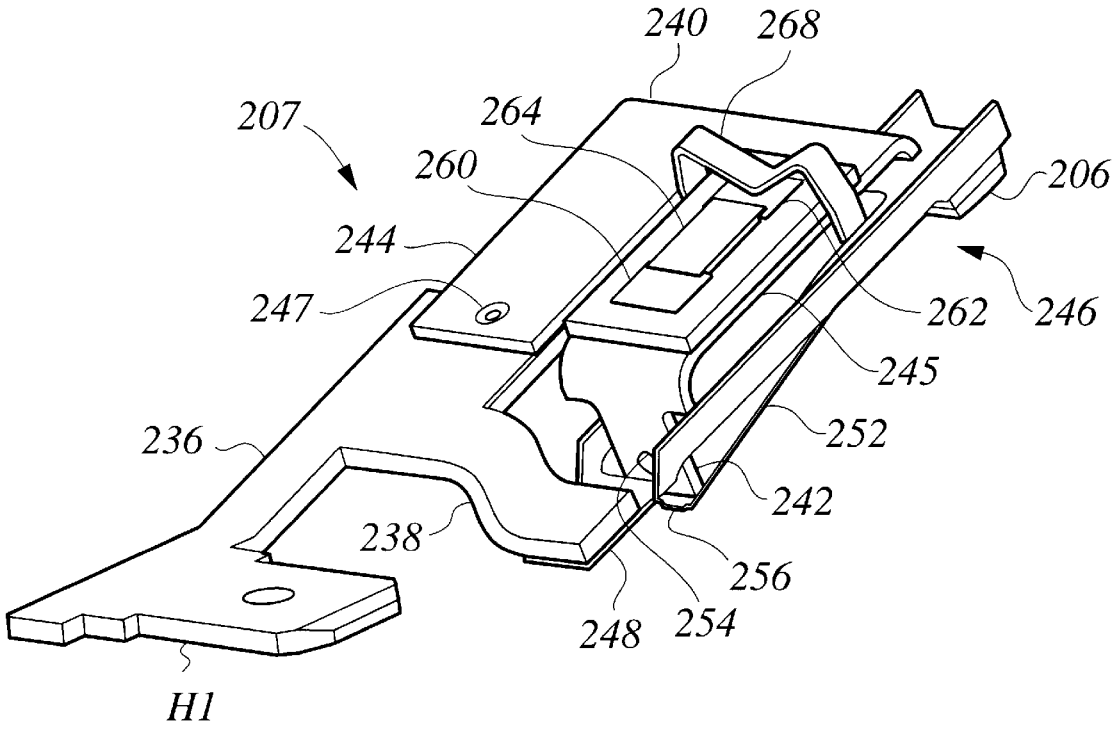
FIG. 28 is an axonometric view of the heat motor sub-assembly of the device of FIG. 24.
Figure 29:
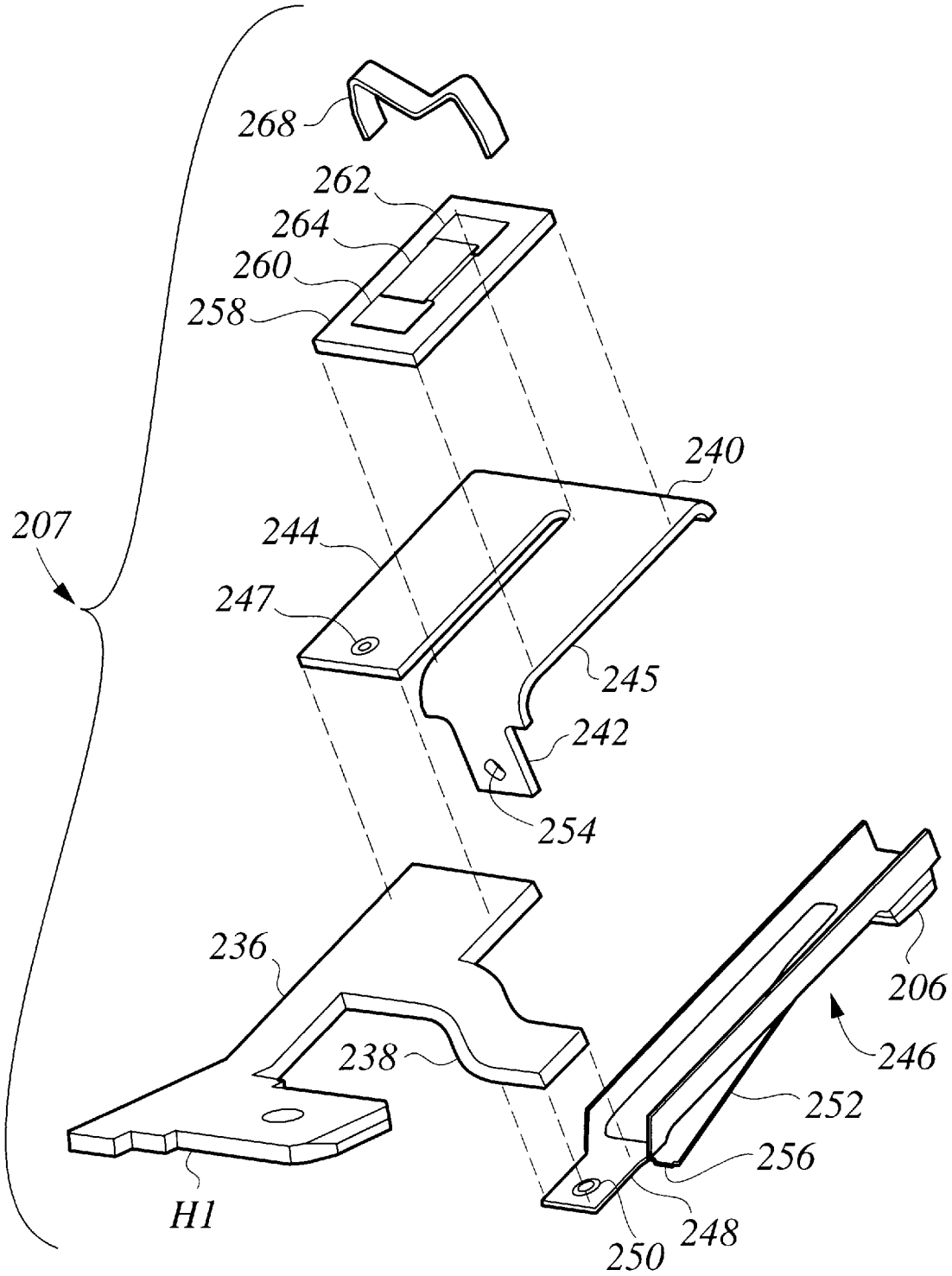
FIG. 29 is an exploded view of the sub-assembly of FIG. 28.

Referring to FIGS. 28 and 29, the heat motor sub-assembly 207 is illustrated in greater detail and includes a base or support member 236 which has terminal H1 formed thereon and which has an offset depending projection 238 extending therefrom in spaced generally parallel relationship to base 236. A bi-metal member 240 having a generally U-shaped configuration has a stiffening portion such as flange 242 extending at right angles from the end of one leg 245 of the member 240, with the opposite leg 244 of member 240 having the end thereof attached to base 236 by a suitable expedient. In the presently preferred practice of the invention, leg 244 of bi-metal member 240 comprises a temperature compensating portion; and, leg 245 comprises an active portion. In the presently preferred practice, the leg 244 of bi-metal 240 is attached to the base 236 by weldment as denoted by reference numeral 247 but it will be understood that other means of attachment as for example riveting may be employed.

A contact arm member indicated generally at 246 has a generally elongated channel-shaped configuration with load current switching contact 206 attached to one end thereof preferably by weldment. The opposite end 248 of the channel 246 is attached to the offset portion 238 of base 236, preferably by weldment as denoted by reference numeral 250.

Arm 246 has a blade spring 252 integrally formed therewith extending in cantilever from the end adjacent contact 206, with the free end of the blade spring 252 having a slight projection 256 formed thereon. The end of blade spring 252 is registered against the end flange 242 of the bi-metal and secured therein by engagement of projection 256 in an aperture or recess 254 provided in the surface of the flange 242. It will be understood that the blade spring is illustrated in FIG. 28 in position just prior to engagement of the projection 256 with aperture 254.

A heater comprising a substrate 258 formed of dielectric material has a pair of spaced conductive pads 260, 262 attached thereto which are interconnected by a film type resistive layer 264. The assembly of the substrate 258 and resistive heater 264 along with end connector tabs 262, 260 is retained on the leg 245 of the bi-metal by a retaining clip 268 which makes electrical contact between end pad 262 and the leg 245 of the bi-metal.

Figure 30:
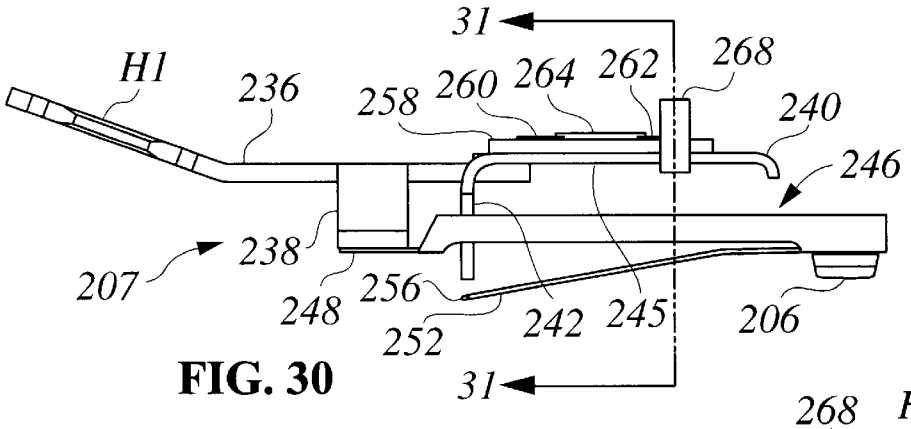
FIG. 30 is a front elevation view of the sub-assembly of FIG. 28 with the bi-metal and the contact arm welded to the support member and the heat motor clip in position for assembly.
Figure 31:
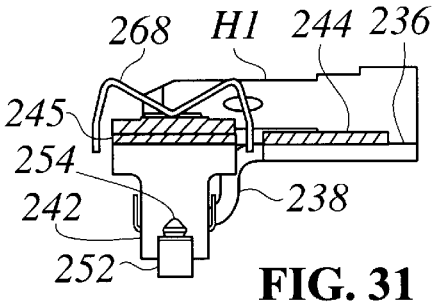
FIG. 31 is a section view taken along section-indicating lines 31—31 of FIG. 30.

Referring to FIGS. 30 and 31, the sub-assembly 207 is shown in the assembled condition with the clip 268 in position prior to deforming. The blade spring 252 is shown in the position prior to engagement with the aperture 254 of bi-metal flange 242.

Figure 32:
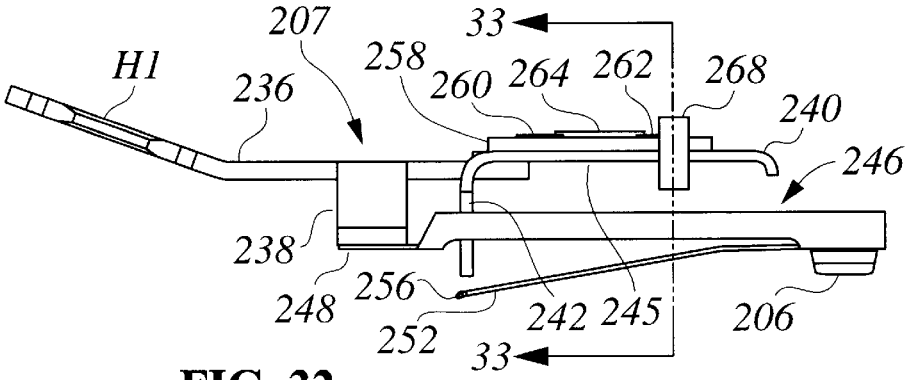
FIG. 32 is a view similar to FIG. 30 showing the retaining clip partially deformed downwardly.
Figure 33:
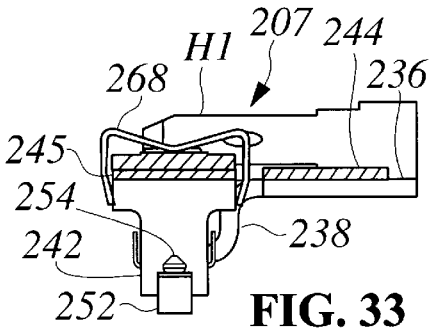
FIG. 33 is a section view taken along section indicating lines 33—33 in FIG. 32.

Referring to FIGS. 32 and 33, the clip 268 is shown in an intermediate stage of assembly with legs thereof pushed downwardly by suitable tooling (not shown) with the sides of the clip partially drawn together along the sides of the leg 245 of the bi-metal member 240.

Figure 34:
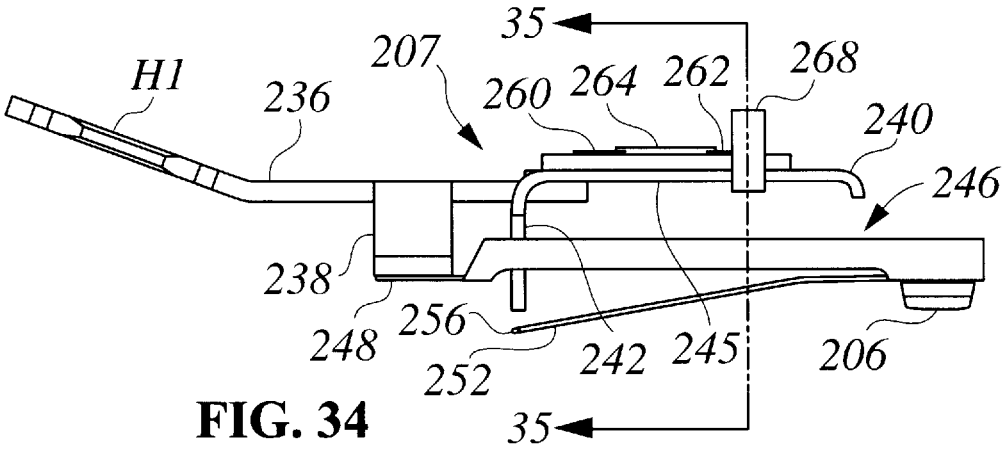
FIG. 34 is a view similar to FIG, 30 showing the retaining clip fully deformed with ends folded under.
Figure 35:
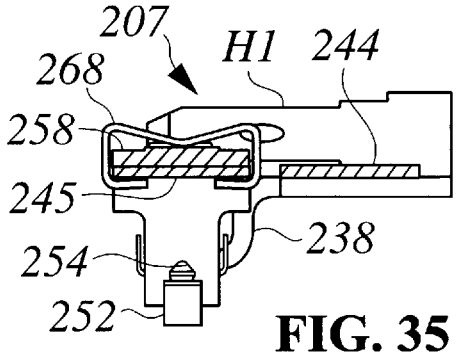
FIG. 35 is a section view taken along section indicating lines 35—35 of FIGS. 34; and, FIG. 36 is a view similar to FIG. 30, with portions broken away showing the end of the blade spring registered in the aperture on the bi-metal with the spring bowed.

Referring to FIGS. 34 and 35, the clip 268 is shown in its fully assembled configuration wherein the ends of the clip have been folded under the bi-metal arm 245 to retain the heater 264 and substrate 258 in place on the bi-metal and to make electrical connection between the end pad 262 of the heater and the bi-metal arm 245. It will be understood that the operation of deforming the ends of the clip 268 is performed by suitable external tooling (not shown).

Figure 36:
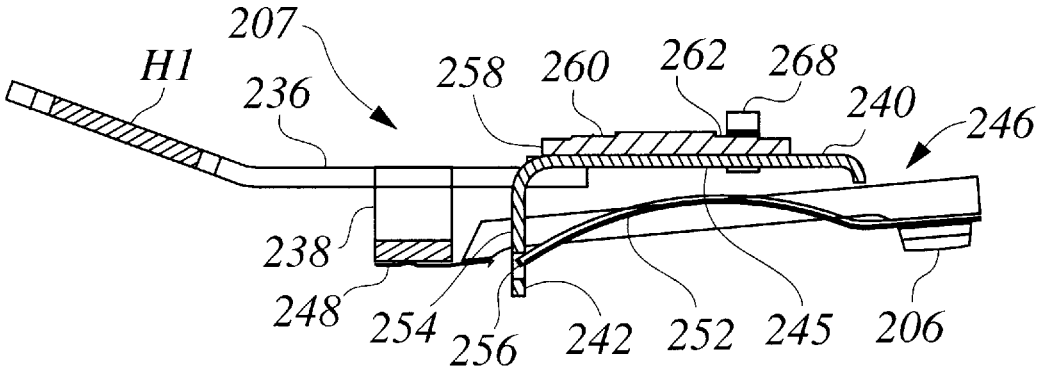

Referring to FIG. 36, the blade spring 252 is shown as deflected upward and with the end projection 256 registered in aperture 254 provided in the bi-metal flange 242. The operation of bowing or deflecting the blade spring 250 to engage the end in aperture 254 may either be performed manually or with the aid of external tooling (not shown). With the blade spring bowed as shown in FIG. 36, upward movement of bi-metal arm 245 causes spring 252 to go over center with respect to end 248 of arm 246 and effects a snap acting movement of contact 206 with respect to contact 204.

The completion of the operation of bowing spring 250 thus completes the heat motor sub-assembly 207 which may then be installed as a unit into the housing of the regulator assembly.

In the installed condition of sub-assembly 207, shown in FIGS. 24–27 it will be understood that the lower end of conductive strip 211 makes contact with heater conductive pad 260; and, cam follower spring 234 is disposed to contact and exert a bias force on the end of flange 262 of active bi-metal arm 245.

The present invention thus provides a unique and novel controller for duty cycle regulating an electrical load with a user selectable fractional duty cycle of "on" time. The controller of the present invention employs a heat motor utilizing a bi-metal which, upon heat transfer thereto and warpage thereof, overcomes the bias of a spring pre-deflected by the user rotation of a cam which bias is applied to the load current switch and cycles the switch to the open position. The controller of the present invention has a minimum of parts and has the heat motor configured to simplify manufacture, assembly and calibration.

The controller of the present invention utilizes a heat motor sub-assembly comprising a base with integral load connecting terminal, the heater, a generally U-shaped bi-metal arm with heater attached by a clip and moveable portions of the load current switch including an integrally formed blade spring for effecting snap action of the load switch. The sub-assembly is pre-fabricated and installed as a unit in the controller housing which simplifies the final assembly of the controller and improves the accuracy and repeatability of the controller operation.

Although the invention has hereinabove been described with respect to the illustrated embodiments, it will be understood that the invention is capable of modification and variation and is limited only by of the following claims.

We claim:

1. A heat motor operated regulating switch assembly comprising:

(a) a base member having a projection extending therefrom;

(b) a bi-metal member having a substantially U-shaped configuration and having an end of a first leg of said U-shape attached to said base member and extending in cantilever therefrom;

(c) a heater attached to said bi-metal member and operable upon electrical energization to effect warping of said bi-metal;

(d) a moveable contact member having a spring portion integrally formed therewith, said contact member having an end attached to said base member and an end of said spring portion registered on the leg of said U-shaped bi-metal member opposite said first leg, wherein said spring portion is preloaded in compression, and upon user movement of said spring portion overcenter, said spring portion effects a snap action movement, to said contact member; and, (e) a means housing said base including a stationary contact disposed for closing and opening with said moveable contact member, wherein said base, said bi-metal member, said heater and said contact member are assembled as a sub-assembly which is installed as a unit in said means housing said base.

2. The switch assembly defined in claim 1, wherein said moveable contact member has a channel like configuration.

3. The switch assembly defined in claim 1, wherein said heater comprises an electrically resistive strip.

4. The switch assembly defined in claim 1, wherein said base member includes integrally formed therewith a connector terminal portion.

5. The switch assembly defined in claim 1, wherein said U-shaped bi-metal member has a substantially flat plate configuration, and the end of said leg opposite said first leg is formed at substantially right angles with said spring portion of said moveable contact registered thereon.

6. The switch assembly defined in claim 1, wherein said moveable contact member includes a noble metal contact attached thereto.

7. The switch assembly defined in claim 1, wherein said moveable contact member is electrically isolated from said heater.

8. The switch assembly defined in claim 1, wherein said moveable contact member is attached to said base member by weldment.

9. The switch assembly defined in claim 1, wherein said moveable contact member has an elongated channel shaped configuration and said spring portion comprises a cantilever blade formed integrally in the web of the channel.

10. A method of making a heat motor operated regulating controller comprising:

(a) providing a housing and disposing thereon a stationary switching contact and a first terminal adapted for external load circuit connection and connecting said contact and said first terminal;

(b) providing a base and forming thereon a second terminal adapted for external load circuit connection and disposing thereon a bi-metal member having an active and temperature compensating portion;

(c) disposing a heater on said bi-metal active portion;

(d) forming a moveable contact member with an integral blade spring member having one end extending therefrom;

(e) attaching an end of said contact member to said active portion of said bi-metal member and registering said blade spring one end on said bi-metal active portion and preloading said blade spring and forming a heat motor sub-assembly;

(f) installing said heat motor sub-assembly as a unit in said housing, selectively biasing said bi-metal active portion and moving said blade spring and closing said contact member against said stationary switching contact; and, (g) heating said bimetal and effecting movement of said blade spring for opening said stationary contact.

11. The method defined in claim 10 wherein said step of disposing a bi-metal member includes forming a substantially U-shaped bi-metal member with one leg of said U-shape comprising said active portion and the opposite leg of said U-shape comprising said temperature compensating portion.

12. The method defined in claim 10 wherein said step of selectively biasing includes rotating a cam and moving a cam follower and applying a preload to said bi-metal active portion.

* * * * *